US011761269B2

(12) United States Patent
Firth et al.

(10) Patent No.: US 11,761,269 B2
(45) Date of Patent: Sep. 19, 2023

(54) WELLHEAD PENETRATOR FOR ELECTRICAL CONNECTIONS

(71) Applicant: INNOVEX DOWNHOLE SOLUTIONS, INC., Houston, TX (US)

(72) Inventors: Gary Firth, Houston, TX (US); Brian Sneed, Houston, TX (US)

(73) Assignee: INNOVEX DOWNHOLE SOLUTIONS, INC, Houston, TX (US)

( * ) Notice: Subject to any disclaimer, the term of this patent is extended or adjusted under 35 U.S.C. 154(b) by 0 days.

(21) Appl. No.: 18/051,591

(22) Filed: Nov. 1, 2022

(65) Prior Publication Data

US 2023/0075553 A1 Mar. 9, 2023

Related U.S. Application Data

(63) Continuation-in-part of application No. 17/495,414, filed on Oct. 6, 2021.

(60) Provisional application No. 63/088,714, filed on Oct. 7, 2020.

(51) Int. Cl.
*E21B 17/02* (2006.01)
*E21B 33/068* (2006.01)

(52) U.S. Cl.
CPC ..... *E21B 17/028* (2013.01); *E21B 33/068* (2013.01)

(58) Field of Classification Search
CPC ..... E21B 33/0353; E21B 33/0385; E21B 33/0407; E21B 33/068; E21B 17/028
See application file for complete search history.

(56) References Cited

U.S. PATENT DOCUMENTS 2,718,543 A 9/1955 Douglas
3,188,118 A * 6/1965 Jones ..... E21B 33/04 285/123.6
3,816,641 A 6/1974 Iversen
(Continued)

FOREIGN PATENT DOCUMENTS

WO 95-21483 A1 8/1995

OTHER PUBLICATIONS

Seung Hoon Bahng (Authorized Officer), International Search Report and Written Opinion dated Feb. 4, 2022, PCT Application No. PCT/US2021/053762, 11 pages.
(Continued)

*Primary Examiner* — D. Andrews
(74) *Attorney, Agent, or Firm* — MH2 Technology Law Group LLP

(57) ABSTRACT

A wellhead penetrator includes a mandrel configured to be positioned in a tubing hanger, a wellhead, or both. The wellhead penetrator also includes a housing positioned at least partially within the mandrel. The housing defines a housing bore formed axially therethrough that is configured to receive upper and lower portions of a cable. The upper and lower portions are separated by a gap. The wellhead penetrator also includes a sealing element positioned at least partially within the mandrel and below the housing. The wellhead penetrator is configured to actuate from a first state to a second state in response to a downward force being exerted on the lower portion of the cable. The wellhead penetrator in the first state has the lower portion of the cable positioned at least partially within the housing such that a splice connection exists between the upper and lower portions of the cable.

20 Claims, 20 Drawing Sheets

(56) References Cited

U.S. PATENT DOCUMENTS

| | | | | |
|---|---|---|---|---|
| 3,945,700 | A | 3/1976 | Didier | |
| 4,583,804 | A | 4/1986 | Thompson | |
| 4,693,534 | A * | 9/1987 | Clark | H01R 13/533 439/736 |
| 4,995,646 | A | 2/1991 | Johnston et al. | |
| 10,280,701 | B2 * | 5/2019 | Emerson | E21B 33/0407 |
| 10,871,040 | B2 | 12/2020 | Ames | |
| 2014/0110164 | A1 | 4/2014 | Emerson et al. | |
| 2019/0218878 | A1 * | 7/2019 | Sneed | E21B 33/0355 |
| 2020/0291736 | A1 | 9/2020 | Emerson | |

OTHER PUBLICATIONS

Non-Final Office Action dated Feb. 21, 2023, U.S. Appl. No. 17/495,414, 17 pages.

* cited by examiner

WELLHEAD PENETRATOR FOR ELECTRICAL CONNECTIONS

CROSS-REFERENCE TO RELATED APPLICATIONS

This application is a continuation-in-part (CIP) of U.S. patent application Ser. No. 17/495,414, filed on Oct. 6, 2021, which claims priority to U.S. Provisional Patent Application No. 63/088,714, filed on Oct. 7, 2020. Both applications are incorporated by reference herein.

BACKGROUND

Wellheads are connected to the top of a well and act as a surface termination for the well. Further, wellheads generally provide for a production tubing hanger to be installed therein. The production tubing extends downward from the hanger into the well. Produced fluid is received up through the production tubing and through the wellhead, e.g., via valves, rams, seals, and/or other surface equipment.

In many cases, a pump is installed along with the production tubing. The pump facilitates the removal of produced fluids (e.g., hydrocarbons) from the well up through the production tubing. The pump is generally electrically powered, and thus often referred to as an electric submersible pump or ESP.

A power cable is typically run from a power source at the surface (e.g., a generator or the power grid), along the production tubing, and down to the ESP. While this reliably and efficiently provides power to the ESP, extending the cable through the wellhead can present challenges. In particular, the environment within the wellhead can be harsh, and potentially at high pressure. Leakage of fluids from out of the wellhead, such as through a hole formed for an ESP cable is generally undesirable. Further, spliced connections through the wellhead can represent failure points for electrical conductivity to the ESP. Accordingly, wellhead penetrators have been developed to mitigate the potential for such leakage.

SUMMARY

A wellhead penetrator is disclosed. The wellhead penetrator includes a mandrel configured to be positioned in a tubing hanger, a wellhead, or both. The wellhead penetrator also includes a housing positioned at least partially within the mandrel. The housing defines a housing bore formed axially therethrough that is configured to receive upper and lower portions of a cable. The upper and lower portions are separated by a gap. The wellhead penetrator also includes a sealing element positioned at least partially within the mandrel and below the housing. The wellhead penetrator is configured to actuate from a first state to a second state in response to a downward force being exerted on the lower portion of the cable. The wellhead penetrator in the first state has the lower portion of the cable positioned at least partially within the housing such that a splice connection exists between the upper and lower portions of the cable. The wellhead penetrator in the second state has the lower portion of the cable withdrawn from the housing, such that the splice connection no longer exists.

In another embodiment, the wellhead penetrator includes a mandrel. The wellhead penetrator also includes a housing positioned at least partially within the mandrel. The housing defines a housing bore formed axially therethrough. The wellhead penetrator also includes a connector positioned at least partially within the housing bore. The connector includes an upper portion and a lower portion. The upper portion of the connector is configured to receive an upper portion of a cable. The wellhead penetrator also includes a sleeve positioned at least partially within the housing bore. The sleeve is positioned at least partially within the lower portion of the connector. The sleeve defines a sleeve bore that extends partially therethrough. The wellhead penetrator also includes a conductor pin configured to be positioned at least partially within the sleeve bore. The conductor pin is configured to receive a lower portion of the cable. The wellhead penetrator also includes a sealing element positioned at least partially within the mandrel. The sealing element is positioned at least partially below the housing. The conductor pin is coupled to the sealing element. The sealing element includes one or more skirts on an outer surface thereof that contact an inner surface of the mandrel. The wellhead penetrator is configured to actuate from a first state to a second state in response to a downward force being exerted on the lower portion of the cable. The wellhead penetrator in the first state has the lower portion of the cable positioned at least partially within the conductor pin, and the conductor pin positioned at least partially within the sleeve. The wellhead penetrator in the second state has the lower portion of the cable positioned at least partially within the conductor pin, and the conductor pin withdrawn from the sleeve.

A method is also disclosed. The method includes positioning a wellhead penetrator at least partially in a tubing hanger, a wellhead, or both. The wellhead penetrator includes a mandrel. The wellhead penetrator also includes a housing positioned at least partially within the mandrel. The housing defines a housing bore formed axially therethrough that is configured to receive upper and lower portions of a cable. The wellhead penetrator also includes a sealing element positioned at least partially within the mandrel and below the housing. The method also includes performing an operation in a wellbore, which causes a downward force to be exerted on the lower portion of the cable. The wellhead penetrator is configured to actuate from a first state to a second state in response to the downward force. The wellhead penetrator in the first state has the lower portion of the cable positioned at least partially within the housing such that a splice connection exists between the upper and lower portions of the cable. The wellhead penetrator in the second state has the lower portion of the cable withdrawn from the housing, such that the splice connection no longer exists.

BRIEF DESCRIPTION OF THE DRAWINGS

The present disclosure may best be understood by referring to the following description and accompanying drawings that are used to illustrate some embodiments. In the drawings.

DETAILED DESCRIPTION

Figure 1A:
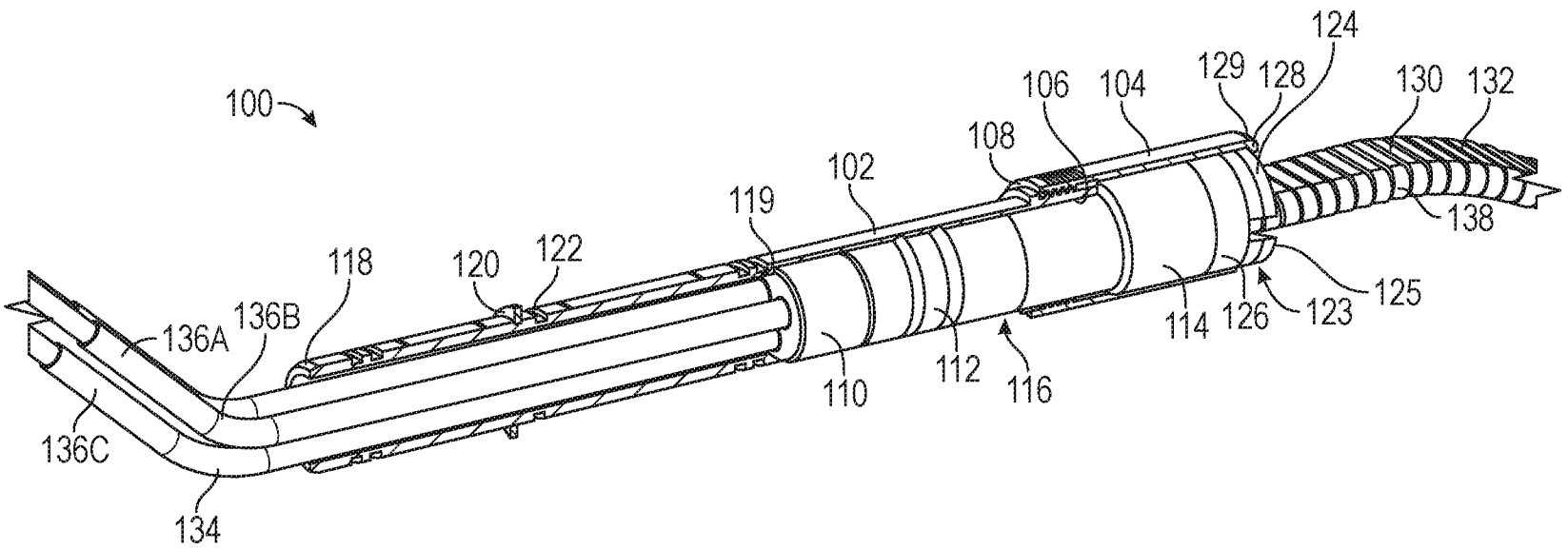
FIG. 1A illustrates a perspective sectional view of a wellhead penetrator, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1A illustrates a perspective view of a wellhead penetrator 100 configured to extend into a wellhead, providing a sealed path for electrically-conductive cables, wires, leads, etc., through the wellhead, according to an embodiment. The wellhead penetrator 100 may be configured to provide electrical conductivity through the wellhead from a power source at the surface to a pump or another electronic device within the well.

In an embodiment, the wellhead penetrator 100 may include an outer mandrel 102 and a lock nut 104, with the outer mandrel 102 being threaded into engagement with the lock nut 104. For example, the mandrel 102 may have an end 106 that is externally (male) threaded, while the lock nut 104 may have an end 108 that is internally (female) threaded. Accordingly, rotation of the mandrel 102 and the lock nut 104 relative to one another (by rotating either or both relative to a stationary reference frame) may advance the lock nut 104 onto the mandrel 102. In other embodiments, the lock nut 104 may instead be received into the mandrel 102. The mandrel 102 and the lock nut 104 may thus both be cylindrical, or at least partially cylindrical, and generally define collinear central longitudinal axes therethrough. As the term is used herein, "axial" means in a direction parallel to the central longitudinal axis of the cylindrical mandrel 102 and/or lock nut 104, while "radial" refers to a direction perpendicular to the axial direction (i.e., perpendicular to the central longitudinal axes).

The mandrel 102 and the lock nut 104 may be hollow, and thus the combination thereof (when connected together) may house several components therein. For example, a backup member 110 and a sealing element 112 may be housed within the mandrel 102 and may be axially-adjacent to one another, e.g., in axial engagement with one another and/or connected together. The sealing element 112 may be made from a resilient material suitable for forming a seal within the mandrel 102, such as, for example, rubber or another elastomeric or polymeric material. The backup member 110 may be made from any suitable material (e.g., metal, plastic, ceramic, etc.). An encapsulant collar 114 may be housed at least partially in the mandrel 102 and at least partially within the lock nut 104. The encapsulant collar 114 may also be metallic (or another suitable material), and may contain encapsulant therein, as will be described in greater detail below. Further, the encapsulant collar 114 may be separated axially apart from the sealing element 112 by a gap 116, which may be filled with encapsulant, in an embodiment, and defined between the encapsulant collar 114 and the sealing element 112.

On the opposite axial side of the backup member 110, the mandrel 102 may extend for a distance to an upper end 118. A shoulder 119 may retain the back-up member 110 in place within the mandrel 102, and an unsealed section of the mandrel 102 may extend from the shoulder 119 to the upper end 118. A retaining member 120 may be connected to the exterior of the mandrel 102 in alignment with this unsealed section of the mandrel 102. The retaining member 120 may be configured to maintain a position of the wellhead penetrator 100 within the wellhead, as will be described in greater detail below. In some embodiments, the retaining member 120 may be or include a snap ring, which may be received into a recess 122 formed in the exterior of the mandrel 102, but in other embodiments, other structures, devices, geometries of the mandrel 102, etc., may be employed in lieu of or in addition to such a snap ring to provide the retaining member 120.

The wellhead penetrator 100 may also include a cable lock assembly 123. For example, the cable lock assembly 123 may include one or more gripping members (two shown: 124, 125) and a conical bowl 126 into which the one or more gripping members 124, 125 are at least partially received. A lip 128 formed on a lower end 129 of the lock nut 104 may engage the one or more gripping members 124, 125, and thus advancing the lock nut 104 toward the mandrel 102 may drive the gripping members 124, 125 farther into the conical bowl 126, thereby pressing the gripping members 124, 125 radially inward, as will be described in greater detail below.

A cable 130 may extend through the wellhead penetrator 100. For example, the cable 130 may include an armored section 132 and an unarmored section 134. Further, the cable 130 may include two or more (e.g., three) electrically-conductive wires 136A, 136B, 136C. In the armored section 132, the wires 136A-C may extend within an outer protective armor 138, and in the unarmored section 134, the wires 136A-C may extend out of the protective armor 138. In an embodiment, the armored section 132 of the cable 130 may extend from below the wellhead penetrator 100 up through a lower end 129 of the lock nut 104, which may provide an opening, slot, etc. configured to permit passage of the armored section 132 of the cable 130 therethrough. The unarmored section 134 may extend within the lock nut 104 and the mandrel 102, such that the separate wires 136A-C may extend through separate holes formed in the sealing element 112 and the backup member 110, e.g., one for each wire 136A-C. The cable 130 may be flat or round in exterior shape in the armored section 132.

Figure 1B:
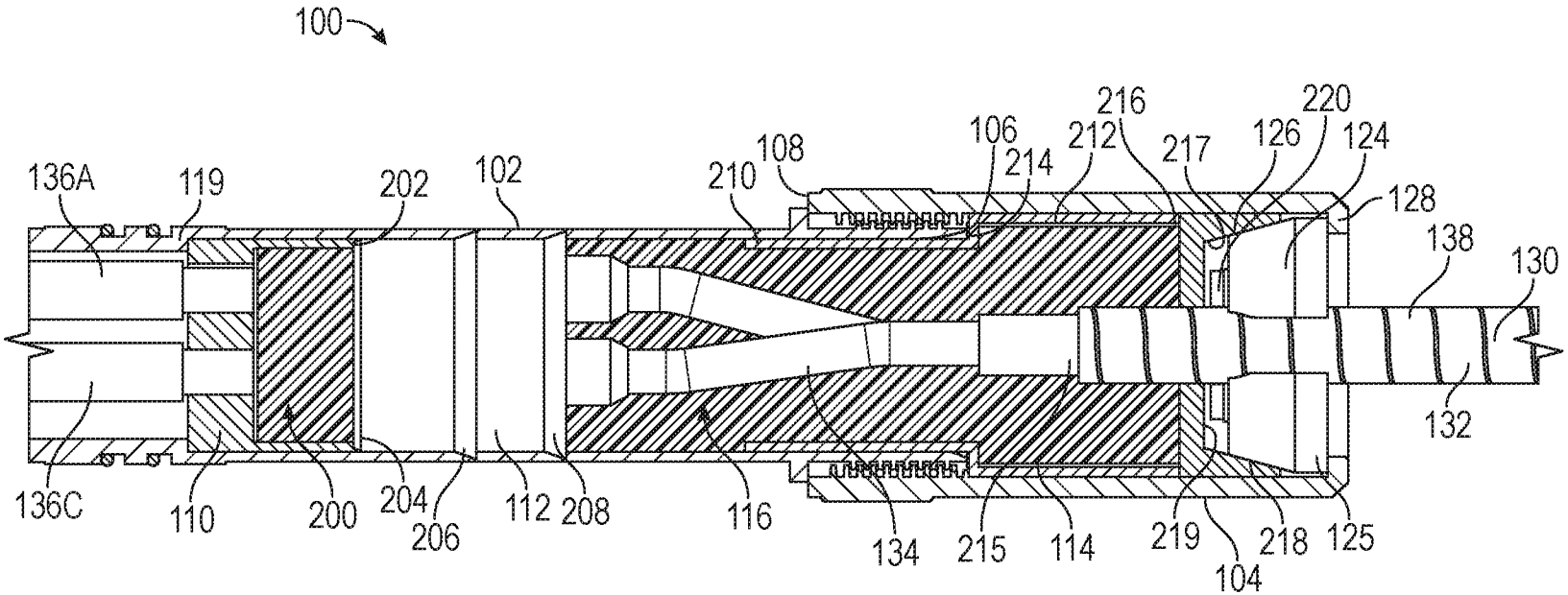
FIG. 1B illustrates an enlarged, side, sectional view of a portion of the wellhead penetrator, according to an embodiment.

FIG. 1B illustrates a side, cross-sectional view of a portion of the wellhead penetrator 100, specifically, the lower portion of the mandrel 102 and the lock nut 104, and those components housed therein, according to an embodiment. As noted above, the backup member 110 and the sealing element 112 may be housed within the mandrel 102. The wires 136A-C (the wire 136B is not visible in this cross-section) extend through separate holes formed in the backup member 110 and sealing element 112.

As shown, the interior of the backup member 110 may define a cavity 200. The cavity 200 may be filled with encapsulant (e.g., epoxy or any other type of sealant material or bonding material). Further, a lower annular end 202 of the backup member 110 may press against the outer edge of an upper surface 204 of the sealing element 112. Further, the sealing element 112 may include two skirts 206, 208, which are separated axially apart from one another. The skirts 206, 208 may engage the inner diameter surface of the mandrel 102, so as to prevent fluid from leaking past the sealing element 112. Further, the annular end 202 of the backup member 110 engaging the upper surface 204 of the sealing element 112 prevents misalignment of the sealing element 112 within the mandrel 102, e.g., maintains a coaxial orientation of the sealing element 112 with respect to the mandrel 102. This may ensure that the skirts 206, 208 uniformly engage the mandrel 102, thereby promoting the formation of an effective seal between the sealing element 112 and the inner diameter surface of the mandrel 102. The encapsulant in the cavity 200 may serve to prevent leakage of any fluid along the wires 136A-C extending through the sealing element 112.

Continuing downward from the sealing element 112, the encapsulant collar 114 is shown located partially within the mandrel 102 and partially within the lock nut 104. In particular, the encapsulant collar 114 may include two sections 210, 212, with the section 212 being radially larger than the section 210. A shoulder 214 is thus formed between the two sections 210, 212. The shoulder 214 may engage the lower end 106 of the mandrel 102, so as to locate the encapsulant collar 114 relative to the mandrel 102. Further, as noted above, the encapsulant collar 114 may be at least partially (e.g., substantially or entirely) filled with encapsulant. The encapsulant may serve to prevent fluid leakage from the well below the wellhead penetrator 100 along the wires 136A-C, and also to protect the wires 136A-C from swelling due to contact with any well fluid that may reach the interior of the penetrator 100. It will thus be noted that there is encapsulant on both axial sides of the sealing element 112, thus preventing fluid passage through the sealing element 112 and maintaining the position and shape of the sealing element 112. In some embodiments, the cable 130 may include a lead layer 215, which may extend within the outer armor 138, and into the unarmored section 134. The lead layer 215 is configured to prevent the well fluid from damaging the wires 136A-C in the well.

The bowl 126 may abut an upper end 216 of the encapsulant collar 114, thereby containing the encapsulant within the encapsulant collar 114. As shown, the interior of the bowl 126 may have a tapered (conical) surface 217, which may be tapered in reverse orientation to a tapered outer surface 218 of the generally wedge-shaped gripping members 124, 125. The bowl 126 may also have an axial-facing bottom surface 219.

As the lock nut 104 is advanced toward the mandrel 102 (e.g., by rotating the lock nut 104 relative to the mandrel 102), the lip 128 may press the gripping members 124, 125 into the bowl 126, toward the bottom surface 219, and the tapered engagement between the surfaces 217, 218 may press the gripping members 124, 125 radially inward, into engagement with the armor 138 of the cable 130. The gripping members 124, 125 may include an anti-crush element 220 thereon, which may constrain how far the gripping members 124, 125 may be moved into the bowl 126. As such, the anti-crush element 220 may prevent the gripping members 124, 125 from advancing so far axially into the bowl 126 that the gripping member 124, 125 press radially into the cable 130 with sufficient force to damage the cable 130. However, the anti-crush element 220 may permit the gripping members 124, 125 to tightly engage the cable 130 and prevent the cable 130 from being removed from the wellhead penetrator 100 under normal operating conditions. In an embodiment, the anti-crush element 220 may be a beveled end of the gripping members 124, 125 themselves, or may be another type of extension or a separate piece configured to contact an axially-facing, bottom of the bowl 126 and thereby prevent further axial advancement of the gripping members 124, 125.

Additionally, pressing the gripping members 124, 125 axially by advancing the lock nut 104 may also serve to apply an axial force on the encapsulant that is within the encapsulant collar 114, and within the gap 116, which may cause the encapsulant to fill any empty spaces or voids, and thereby promote an effective seal. Further, such pressure may be transmitted via the encapsulant to the sealing element 112, which in turn presses the encapsulant within the cavity 200, likewise causing the encapsulant to fill any gaps and thereby promote the formation of an effective seal.

Figure 2:
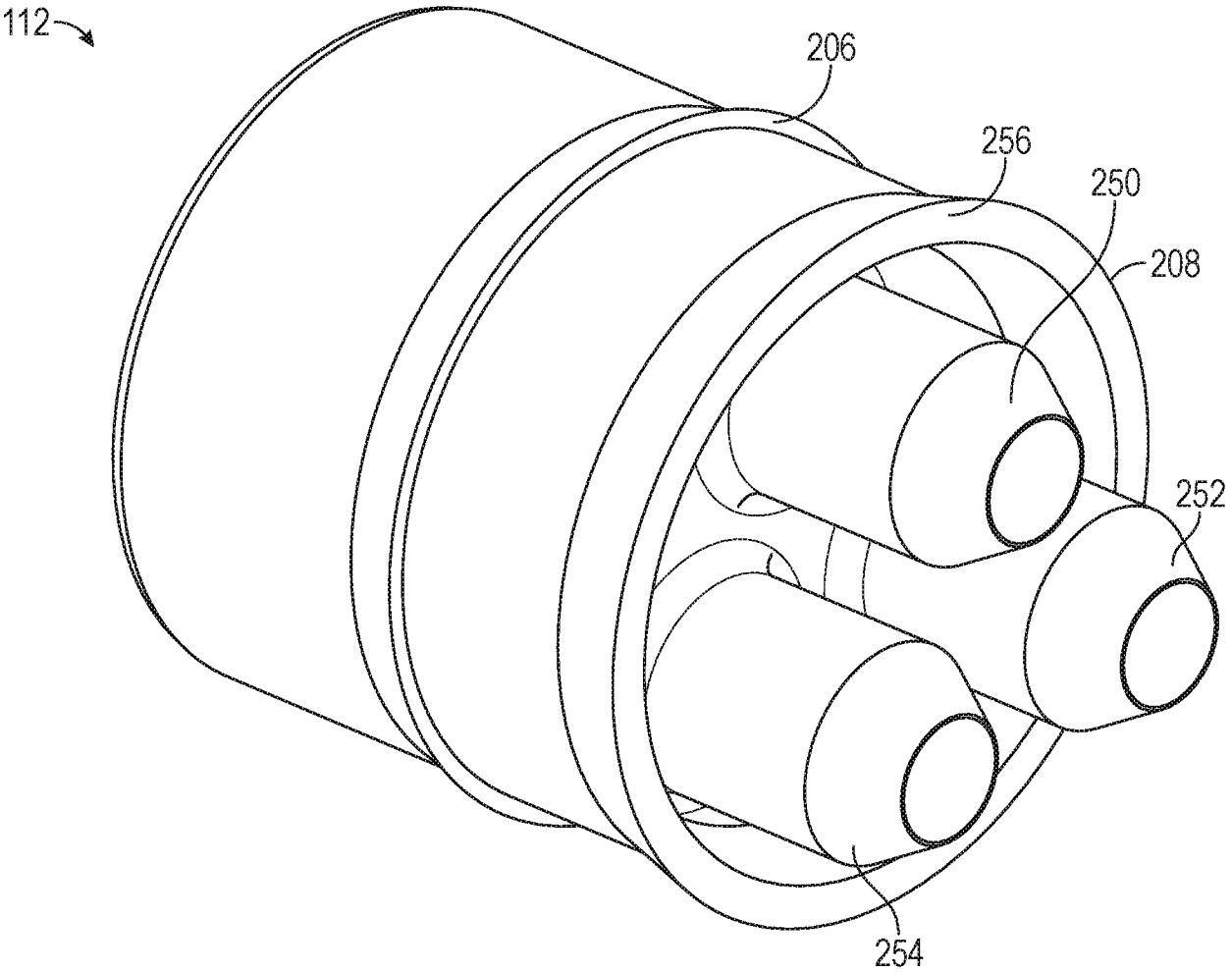
FIG. 2 illustrates a perspective view of a sealing element, according to an embodiment.

Referring now additionally to FIG. 2, there is shown a perspective view of the sealing element 112. As shown, the sealing element 112 may include sleeves or "nipples" 250, 252, 254 extending from a beveled lower surface 256 thereof. The wires 136A-C may extend through the individual nipples 250, 252, 254, such that the nipples 250-254 extend along the insulation on the wires 136A-C to promote formation of a seal therewith. Further, the sealing element 112 is self-energized, because at least the skirts 206, 208 thereof are slightly larger in diameter than the inside of the mandrel 102, while openings in the nipples 250-254 are slightly smaller than the wires 136A-C.

Figure 3:
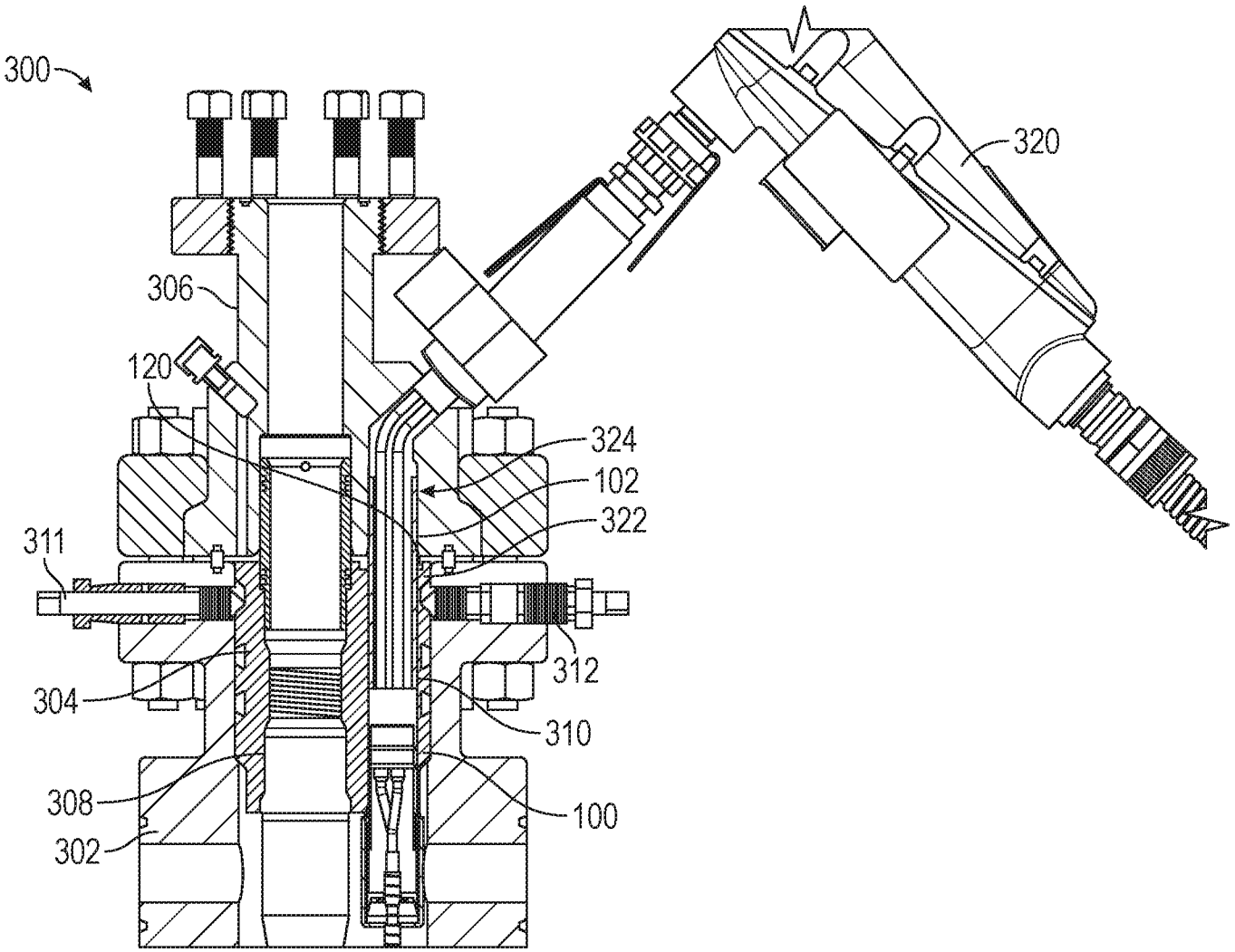
FIG. 3 illustrates a side, sectional view of a wellhead assembly, according to an embodiment.

FIG. 3 illustrates a side, sectional view of a wellhead assembly 300, according to an embodiment. As shown, the wellhead assembly 300 generally includes a wellhead 302, in which a tubing hanger 304 is received. A wellhead adapter 306 may be received onto the top of the wellhead 302 and connected thereto so as to seal the wellhead 302. The tubing hanger 304 may include a first bore 308 configured to connect to and support a production tubing that extends into the wellbore below. The tubing hanger 304 may also include a second bore 310 through which the penetrator 100 extends. The tubing hanger 304 may be secured in place by interaction with one or more shoulders formed in the wellhead 302 and/or one or more set screws (two shown: 311, 312) that extend through the wellhead 302 and engage the tubing hanger 304.

The wellhead assembly 300 may also include a power connection 320. The power connection 320 may be configured to connect to the cable 130 so as to provide power to an electronic submersible pump (ESP) disposed within the wellbore, below the wellhead 302. The power connection 320 may be mounted to the wellhead adapter 306, so as to generally prevent communication between the ambient environment and the interior of the wellhead adapter 306 and the penetrator 100 therein.

As can be seen, the penetrator 100 includes the various components discussed above, which may provide for electrical conductivity through the wellhead 302, while preventing leakage of the wellbore fluids up from within the well. Additionally, the retainer member 120 may be received onto a shoulder 322 formed at the top of the tubing hanger 304, so as to position and support the penetrator 100 with respect to the tubing hanger 304. Further, the mandrel 102 may extend along most or all of the second bore 310 formed vertically in the tubing hanger 304 as well as into and partially through a bore 324 formed in the wellhead adapter 306. Accordingly, the geometry for the second bore 310 may be a relatively simple, straight-through geometry with the shoulder 322 at the top. Such a simple geometry may, for example, enable retrofitting of existing tubing hangers 304 for use with the present penetrator 100 by simply milling out the second bore 308 to a straight profile, with a chamfered shoulder at the top to receive the retainer 120.

Figure 4A:
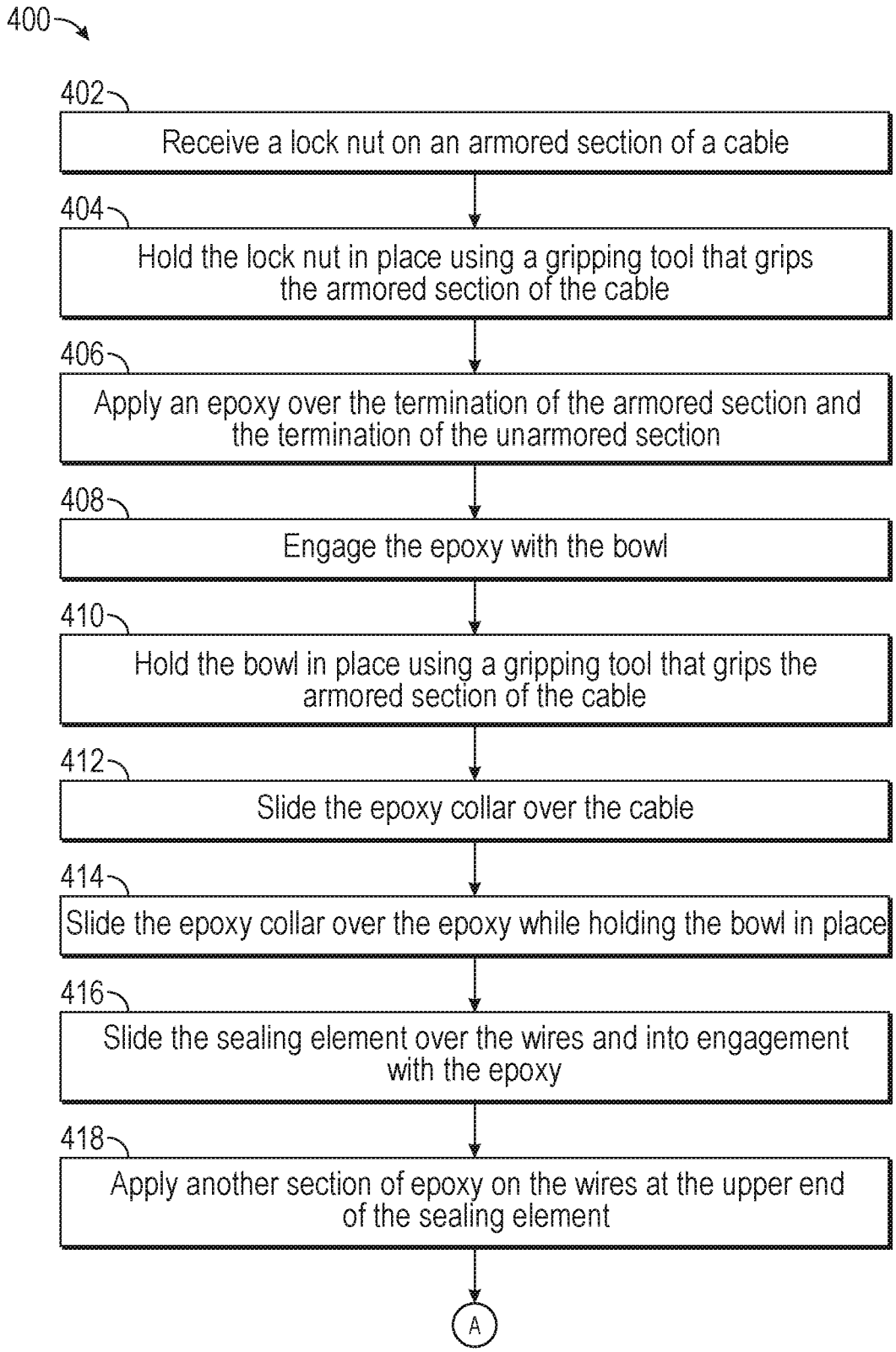
FIGS. 4A and 4B illustrate a flowchart of a method for assembling a wellhead penetrator and installing the wellhead penetrator in a wellhead, according to an embodiment.
Figure 4B:
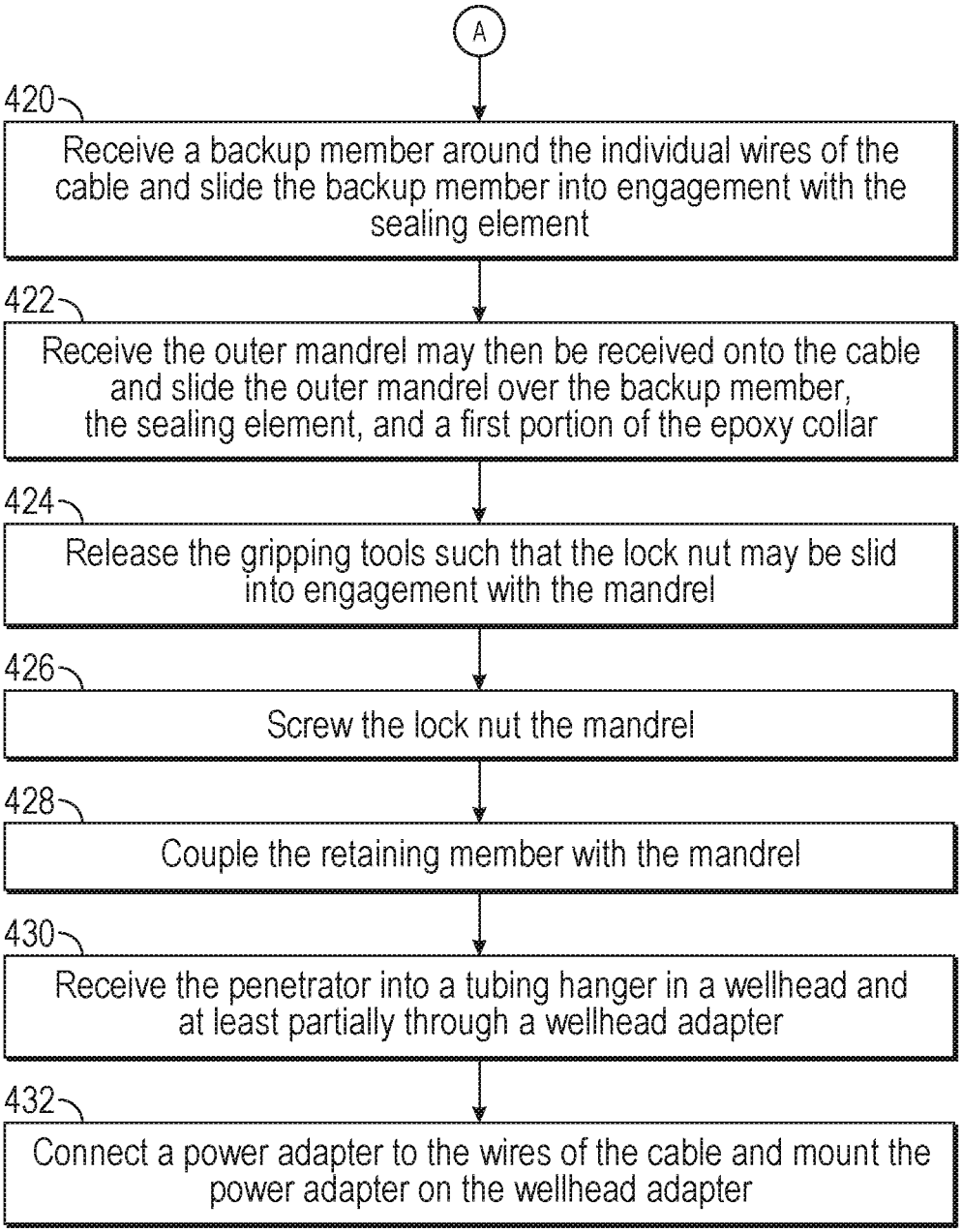

FIGS. 4A and 4B illustrate a flowchart of a method 400 for assembling a wellhead penetrator on a cable, and securing the wellhead penetrator in a wellhead assembly, according to an embodiment. Execution of the method 400 may result in the wellhead penetrator 100 discussed above being secured to the cable 130, which may then be positioned in a wellhead assembly 300 as shown in and discussed above with respect to FIG. 3. Accordingly, the method 400 will be discussed with additional reference to FIGS. 5-12, which provide views of the various stages of the wellhead penetrator 100 being connected to the cable 130. In at least some embodiments, however, the method 400 may be employed to form other types of structures, and thus the method 400 should not be limited to any particular structures unless otherwise stated herein. Further, it will be appreciated that the various steps of the method 400 may be combined, separated, performed in parallel, and/or performed in a different order than depicted herein without departing from the scope of the present disclosure.

Figure 5:
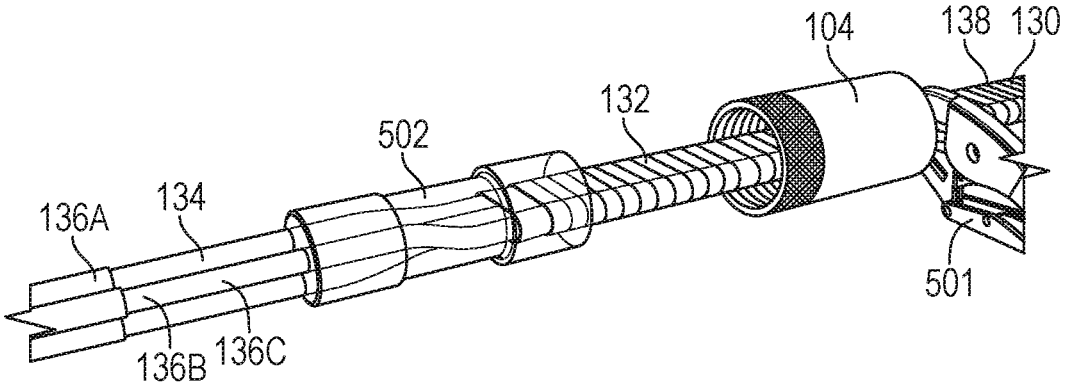
FIGS. 5-12 illustrate the wellhead penetrator being assembled at different stages of the method of FIGS. 4A and 4B, according to an embodiment.

The method 400 may begin by receiving the lock nut 104, e.g., with the clamping assembly 123 therein, on the cable 130, as at 402. The cable 130 may be partially stripped to expose wires 136A-C extending from the outer armor 138, forming the unarmored section 134 and the armored section 132, as discussed above. The lock nut 104 may be slid onto the armored section 132. This is shown in FIG. 5. The lock nut 104 may be held in place by a gripping tool, as at 404, such as vice grips 501, which are configured to grip the armored section 132 of the cable 130. The lock nut 104 may thus be slid up against the vice grips 501, which prevent further sliding of the lock nut 104 along the cable 130.

As also depicted in FIG. 5, in some embodiments, the method 400 may include applying an encapsulant 502 (e.g., a "first" encapsulant) over the termination of the armored section 132 and the termination of the unarmored section 132, as at 406. As such, the encapsulant 502 is applied to both the armored section 132 and the separate wires 136A-C of the unarmored section 134. The encapsulant 502 is illustrated as having a precise form with three cylindrical sections; however, the encapsulant 502 may generally be formed as an amorphous "blob" to begin, and is pressed into conformity with the inner profile of the penetrator 100 by interaction with the other components, as the other components are installed as described herein and press the encapsulant 502 into a desired shape. In other embodiments, the encapsulants may be omitted, as will be described in greater detail below.

Figure 6:
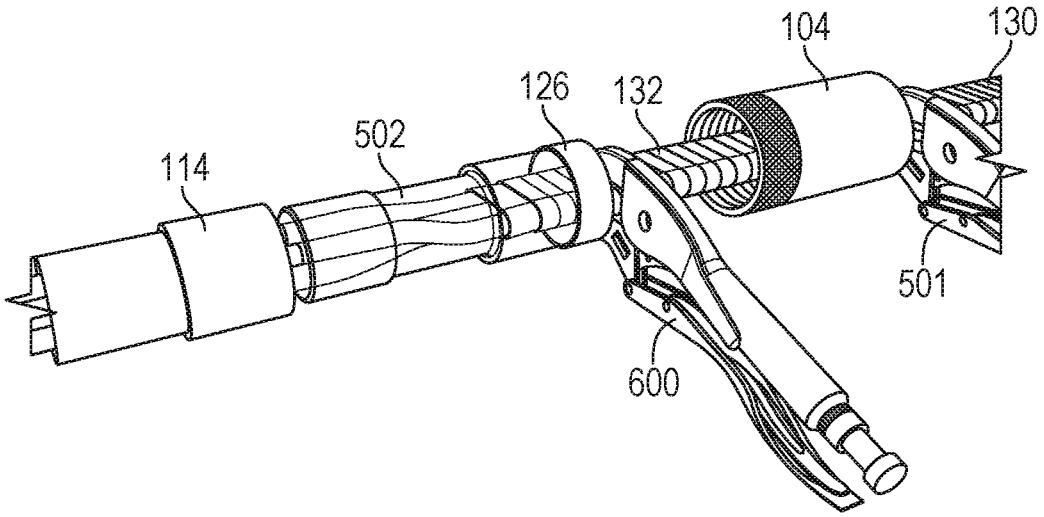

The method 400 may then proceed to engaging the encapsulant 502 with the bowl 126, as at 408. This is illustrated in FIG. 6. The bowl 126 may initially be received onto the cable 130 along with the lock nut 104, and thus may be slid out of the lock nut 104 and pressed against the encapsulant 502. A second pair of vice grips 600, or any other gripping/locating tool to hold the bowl 126 in place, may engage the cable 130 in the armored section 132, thereby holding the encapsulant 502 in place, as at 410. As also illustrated in FIG. 6, the method 400 may then include sliding the encapsulant collar 114 over the cable 130, e.g., over the unarmored section 134 and toward the armored section 132 and toward the encapsulant 502, as at 412.

Figure 7:
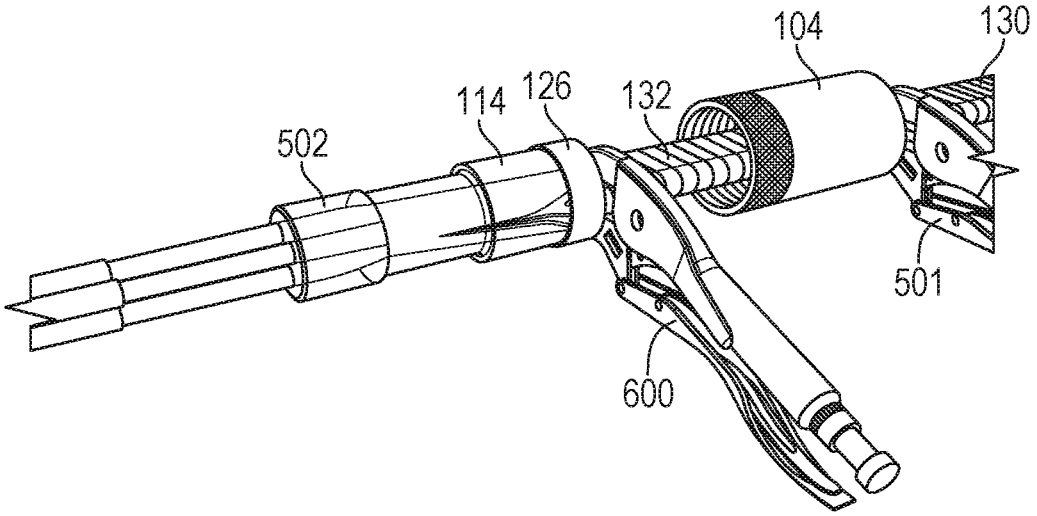

The method 400 may then proceed to sliding the encapsulant collar 114 over the encapsulant 502, while holding the bowl 126 in place, as at 414. This is illustrated in FIG. 7. As shown, the encapsulant 502 may extend past the upper (left) end of the collar 114.

Figure 8:
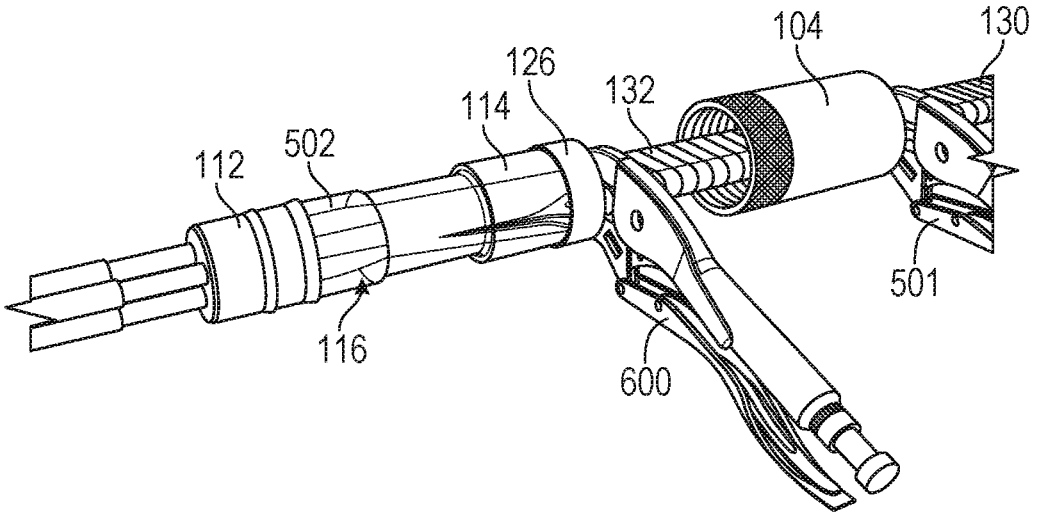
Figure 9:
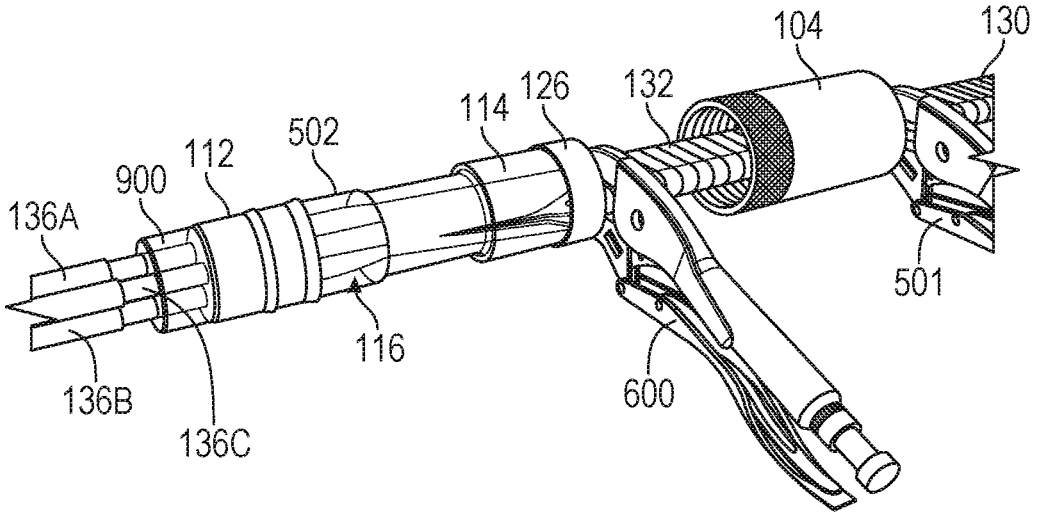

Next, the sealing element 112 may be slid over the wires 136A-C and into engagement with the encapsulant 502, as at 416. This is illustrated in FIG. 8. The portion of the encapsulant 502 that extends up past the end of the encapsulant collar 114 may remain in place, and may be configured to fill the gap 116 between the encapsulant collar 114 and the sealing element 112, as mentioned above with respect to FIGS. 1 and 2. Further, as at 418 and as shown in FIG. 9, another section of encapsulant ("second" encapsulant) 900 may be formed on the upper end of the sealing element 112, and again may start as an amorphous blob. The first and second encapsulant 502, 900 may be formed from the same material or different materials.

Figure 10:
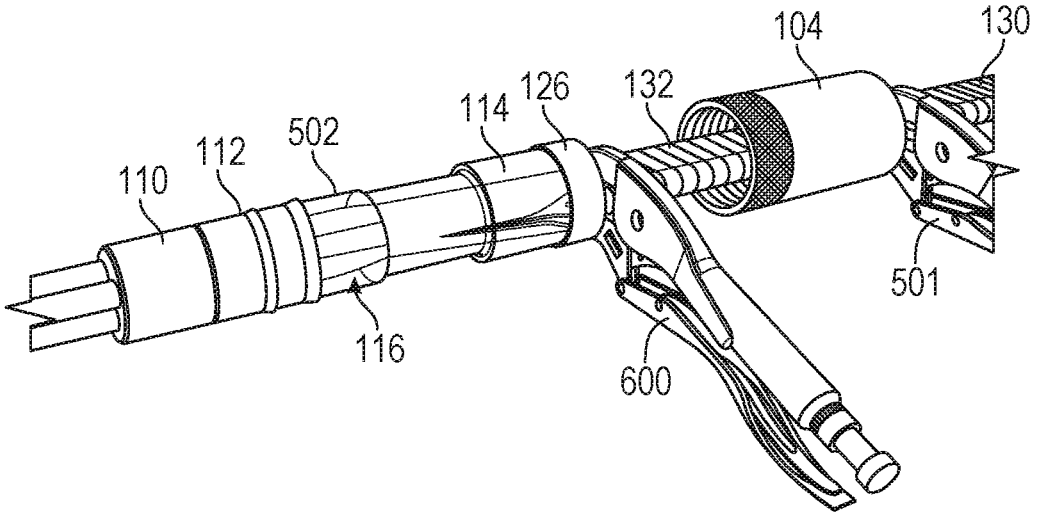

The backup member 110 may then be received around the cable 130, e.g., with a separate passage for each of the wires 136A-C individually, and slid into engagement with the sealing element 112, as at 420. As illustrated in FIG. 10, the backup member 110 may be received around the encapsulant 900, which may reside in the cavity 200 (FIG. 1B) formed therein. Any excess encapsulant 900 may be squeezed out between the backup member 110 and the sealing element 112 during installation of the backup member 110.

Figure 11:
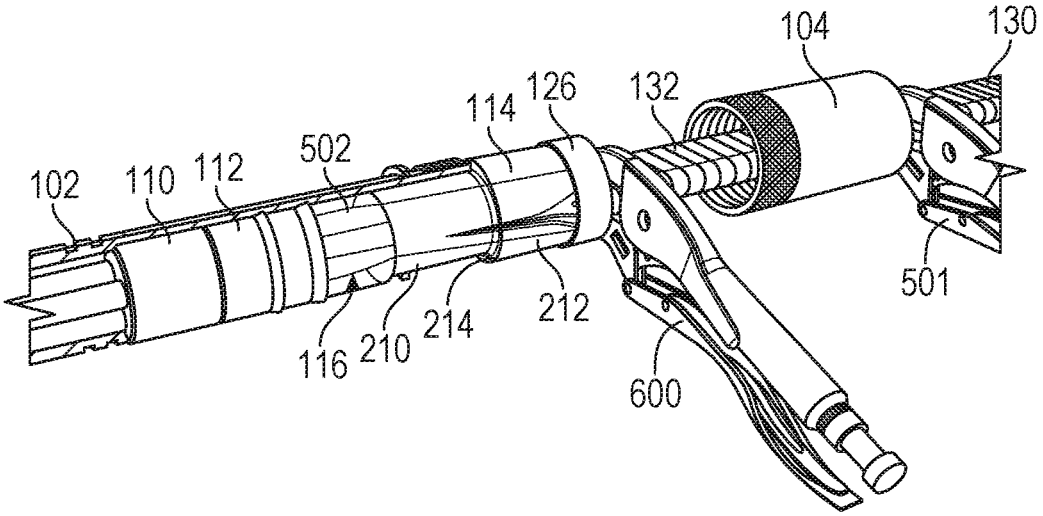
Figure 12:
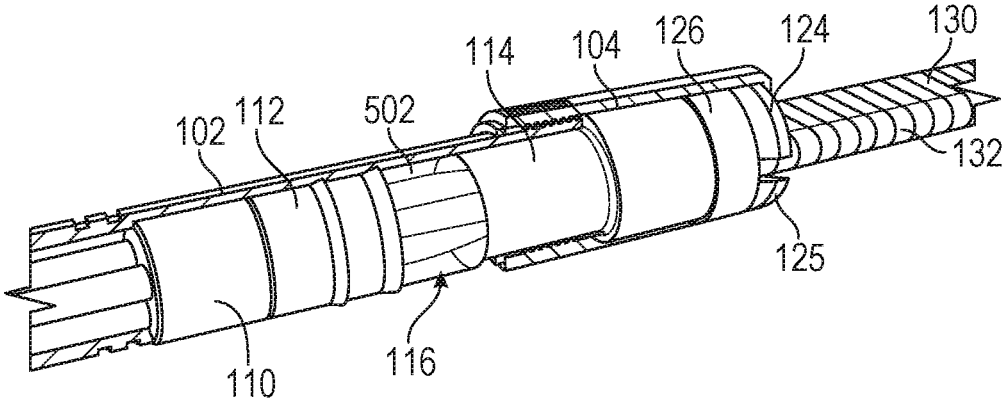

The outer mandrel 102 (shown in half-section) may then be received onto the cable 130 and slid over the backup member 110, the sealing element 112, the encapsulant 502 filling the gap 116, and the first section 210 of the encapsulant collar 114, as at 422. The mandrel 102 may be slid on until it is stopped by engagement with the shoulder 214 of the encapsulant collar 114. This stage is illustrated in FIG. 11.

The gripping tools 501, 506 may then be released, such that the lock nut 104 may be slid into engagement with the mandrel 103, as at 424. The lock nut 104 may then be screwed onto (or otherwise moved axially relative to) the mandrel 102, as at 426. This may proceed by holding the lock nut 104 stationary and rotating the mandrel 102, or by holding the mandrel 102 stationary and rotating the lock nut 104, or by rotating both (e.g., in opposite directions). As described above, screwing the lock nut 104 onto the mandrel 102 causes the lock nut 104 to press the gripping members 124, 125 axially into the bowl 126, and thus radially inwards into engagement with the cable 130, thereby holding the penetrator 100 in position relative to the cable 130. The lock nut 104 may be screwed onto the mandrel 102 until fully threaded thereon, or until, e.g., the encapsulant 504 prevents further advancement of the lock nut 104.

As shown in FIG. 1, the retaining member 120 may be coupled with the mandrel 102, as at 428. As shown in FIG. 3, the penetrator 100 may then be received into the second bore 310 of the tubing hanger 304 and at least partially through the wellhead adapter 306, as at 430. The power connector 320 may then be connected to the wires 136A-C, thereby forming an electrical connection with a submersible pump or another electric device below the wellhead 302. Finally, the power connector 320 may be mounted on the wellhead adapter 306, as at 432.

Figure 13:
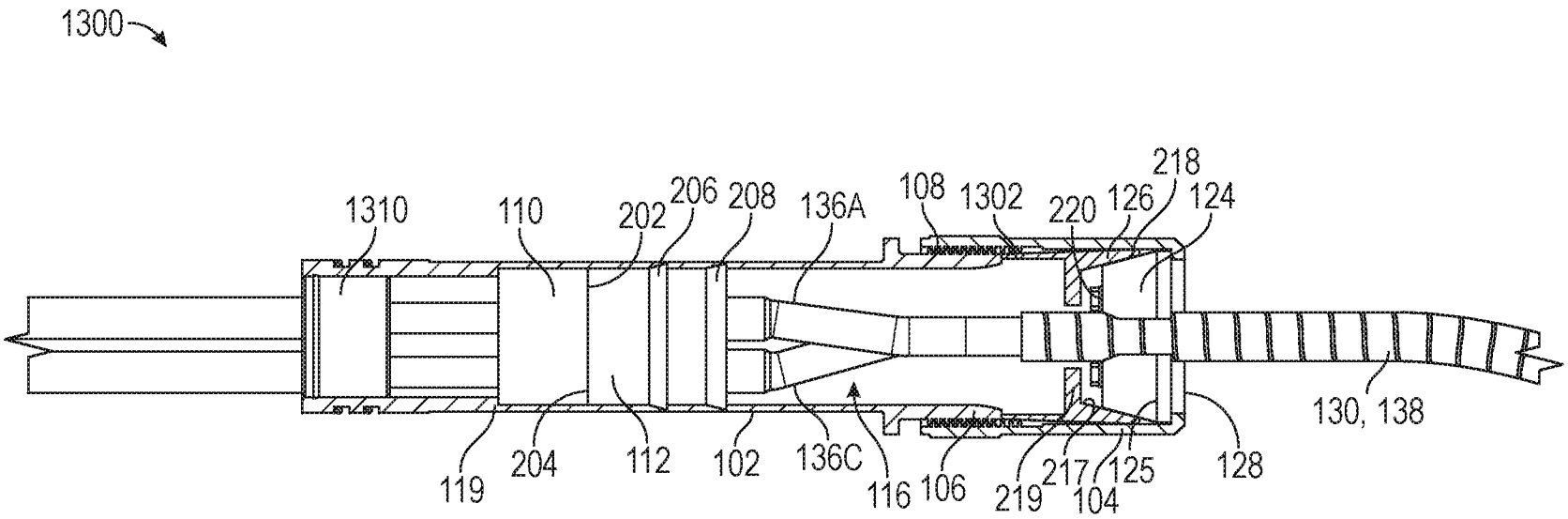
FIG. 13 illustrates a side, cross-sectional view of another wellhead penetrator, according to an embodiment.

In some embodiments, the encapsulant (e.g., epoxy) may be omitted. FIG. 13 illustrates such an embodiment of a wellhead penetrator 1300. The wellhead penetrator 1300 may be generally similar to the wellhead penetrator 100, as discussed above, and thus similar components are given similar reference numbers for ease of understanding and to avoid duplicative descriptions thereof. For example, the wellhead penetrator 1300 may be configured to extend into a wellhead, providing a sealed path for electrically-conductive cables, wires, leads, etc., through the wellhead, according to an embodiment. The wellhead penetrator 1300 may be configured to provide electrical conductivity through the wellhead from a power source at the surface to a pump or another electronic device within the well.

In an embodiment, the wellhead penetrator 1300 may include the outer mandrel 102 and the lock nut 104, with the outer mandrel 102 being threaded into engagement with the lock nut 104. For example, the mandrel 102 may have the end 106 that is externally (male) threaded, while the lock nut 104 may have the end 108 that is internally (female) threaded. Accordingly, rotation of the mandrel 102 and the lock nut 104 relative to one another (by rotating either or both relative to a stationary reference frame) may advance the lock nut 104 onto the mandrel 102. In other embodiments, the lock nut 104 may instead be received into the mandrel 102. The mandrel 102 and the lock nut 104 may thus both be cylindrical, or at least partially cylindrical, and generally define collinear central longitudinal axes therethrough. As the term is used herein, "axial" means in a direction parallel to the central longitudinal axis of the cylindrical mandrel 102 and/or lock nut 104, while "radial" refers to a direction perpendicular to the axial direction (i.e., perpendicular to the central longitudinal axes).

The mandrel 102 and the lock nut 104 may be hollow, and thus the combination thereof (when connected together) may house several components therein. For example, the backup member 110 and the sealing element 112 may be housed within the mandrel 102 and may be axially-adjacent to one another, e.g., in axial engagement with one another and/or connected together. The sealing element 112 may be made from a resilient material suitable for forming a seal within the mandrel 102, such as, for example, rubber or another elastomeric or polymeric material. The backup member 110 may be made from any suitable material (e.g., metal, plastic, ceramic, etc.).

On the opposite axial side of the backup member 110, the mandrel 102 may extend for a distance to the upper end. The shoulder 119 may retain the back-up member 110 in place within the mandrel 102, and an unsealed section of the mandrel 102 may extend from the shoulder 119 to the upper end 118. A retaining member may be connected to the exterior of the mandrel 102 in alignment with this unsealed section of the mandrel 102. The retaining member may be configured to maintain a position of the wellhead penetrator 100 within the wellhead. In some embodiments, the retaining member may be or include a snap ring, which may be received into a recess formed in the exterior of the mandrel 102, but in other embodiments, other structures, devices, geometries of the mandrel 102, etc., may be employed in lieu of or in addition to such a snap ring to provide the retaining member.

The wellhead penetrator 100 may also include a cable lock assembly, as shown. For example, the cable lock assembly may include the gripping members 124, 125 and the conical bowl 126 into which the gripping members 124, 125 are at least partially received. The lip 128 formed on a lower end of the lock nut 104 may engage the gripping members 124, 125, and thus advancing the lock nut 104 toward the mandrel 102 may drive the gripping members 124, 125 farther into the conical bowl 126, thereby pressing the gripping members 124, 125 radially inward, as will be described in greater detail below.

The cable 130 may extend through the wellhead penetrator 100. For example, the cable 130 may include an armored section and an unarmored section. Further, the cable 130 may include two or more (e.g., three) electrically-conductive wires (two are visible: 136A, 136C). In the armored section, the wires 136A-B may extend within an outer protective armor 138, and in the unarmored section, the wires 136A-C may extend out of the protective armor 138. In an embodiment, the armored section of the cable 130 may extend from below the wellhead penetrator 100 up through the lower end of the lock nut 104, which may provide an opening, slot, etc. configured to permit passage of the armored section of the cable 130 therethrough. The unarmored section may extend within the lock nut 104 and the mandrel 102, such that the separate wires 136A-C may extend through separate holes formed in the sealing element 112 and the backup member 110, e.g., one for each wire 136A-C. The cable 130 may be flat or round in exterior shape in the armored section 132.

As noted above, the backup member 110 and the sealing element 112 may be housed within the mandrel 102. The wires 136A,C (the wire 136B is not visible in this cross-section) extend through separate holes formed in the backup member 110 and sealing element 112. As shown, the interior of the backup member 110 may omit the cavity discussed above with reference to FIG. 1B. The backup member 110 may also not include the cavity 200 discussed above for retaining encapsulant between the backup member 110 and the sealing element 112. Thus, the sealing element 112 may not engage encapsulant on either axial side. Rather, the backup member 110 may directly engage the sealing element 112, such that the two interface along all but the conduit areas through which the cables 136A-C extend. In some embodiments, a dovetail connection may be formed and bonding material may be interposed and used to adhere the sealing element 112 and the backup member 110 together.

Further, the sealing element 112 may include two skirts 206, 208, which are separated axially apart from one another. The skirts 206, 208 may engage the inner diameter surface of the mandrel 102, so as to prevent fluid from leaking past the sealing element 112. Further, the annular end 202 of the backup member 110 engaging the upper surface 204 of the sealing element 112 prevents misalignment of the sealing element 112 within the mandrel 102, e.g., maintains a coaxial orientation of the sealing element 112 with respect to the mandrel 102. This may ensure that the skirts 206, 208 uniformly engage the mandrel 102, thereby promoting the formation of an effective seal between the sealing element 112 and the inner diameter surface of the mandrel 102.

The bowl 126 may abut an upper end 216 of the encapsulant collar 114, thereby containing the encapsulant within the encapsulant collar 114. As shown, the interior of the bowl 126 may have a tapered (conical) surface 217, which may be tapered in reverse orientation to a tapered outer surface 218 of the generally wedge-shaped gripping members 124, 125. The bowl 126 may also have an axial-facing bottom surface 219.

As the lock nut 104 is advanced toward the mandrel 102 (e.g., by rotating the lock nut 104 relative to the mandrel 102), the lip 128 may press the gripping members 124, 125 into the bowl 126, toward the bottom surface 219, and the tapered engagement between the surfaces 217, 218 may press the gripping members 124, 125 radially inward, into engagement with the armor 138 of the cable 130. The gripping members 124, 125 may include the anti-crush element 220 thereon, which may constrain how far the gripping members 124, 125 may be moved into the bowl 126. As such, the anti-crush element 220 may prevent the gripping members 124, 125 from advancing so far axially into the bowl 126 that they gripping member 124, 125 press radially into the cable 130 with sufficient force to damage the cable 130. However, the anti-crush element 220 may permit the gripping members 124, 125 to tightly engage the cable 130 and prevent the cable 130 from being removed from the wellhead penetrator 100 under normal operating conditions. In an embodiment, the anti-crush element 220 may be a beveled end of the gripping members 124, 125 themselves, or may be another type of extension or a separate piece configured to contact an axially-facing, bottom of the bowl 126 and thereby prevent further axial advancement of the gripping members 124, 125.

Additionally, pressing the gripping members 124, 125 axially by advancing the lock nut 104 may also serve to apply an axial force on the encapsulant that is within the encapsulant collar 114, and within the gap 116, which may cause the encapsulant to fill any empty spaces or voids, and thereby promote an effective seal. Further, such pressure may be transmitted via the encapsulant to the sealing element 112, which in turn presses the encapsulant within the cavity 200, likewise causing the encapsulant to fill any gaps and thereby promote the formation of an effective seal.

Accordingly, there are several differences that permit the omission of the encapsulant, however. For example, the tapered bowl 126 of the locking assembly has an axial sleeve 1302, which may abut the end 106 of the mandrel 102. The sleeve 1302 may be provided in lieu of the encapsulant collar 114 (e.g., FIGS. 1A and 1B), and the encapsulant collar 114 may be omitted, while still providing sufficient spacing to receive and retain the cable 130 within the lock nut 104, and permit the cables 136A-C to extend from the armor 138 and be separated so as to be received through the separate conduits in the sealing element 112. The gap 116 within the mandrel 102, above the sealing element 112 may be empty.

Further, in some embodiments, the backup member 110 and the sealing element 112 may be connected together by molding the (e.g., elastomeric) sealing element 112 directly to the (e.g., metallic) backup member 110. The backup member 110 may engage the shoulder 119, which serves to prevent the backup member 110 from proceeding through the mandrel 102 and out of the open upper end opposite to the lock nut 104. The backup member 110 may be relative rigid as compared to the sealing element 112, and may be closely toleranced with the mandrel 102, including the shoulder 119, so as to prevent the sealing element 112 from extruding therepast in high pressure environments.

Additionally, a debris barrier 1310 may be received into the upper end of the mandrel 102, and may sealed therein. The debris barrier 1310 may not be configured to experience high pressure differentials, but may prevent ingress of contaminants into contact with the components positioned within the mandrel 102.

Accordingly, the cable lock assembly provided by the tapered bowl 126 and the gripping members 124, 125 may grip and retain the cable 130. Further, any axial forces incident on the cable 130 may be transmitted through mandrel 102 to the upper end thereof, so as to resist displacement of the cable 130 with respect to the well head penetrator 1300.

Wellhead Penetrator with Dual Barrier

Figure 14:
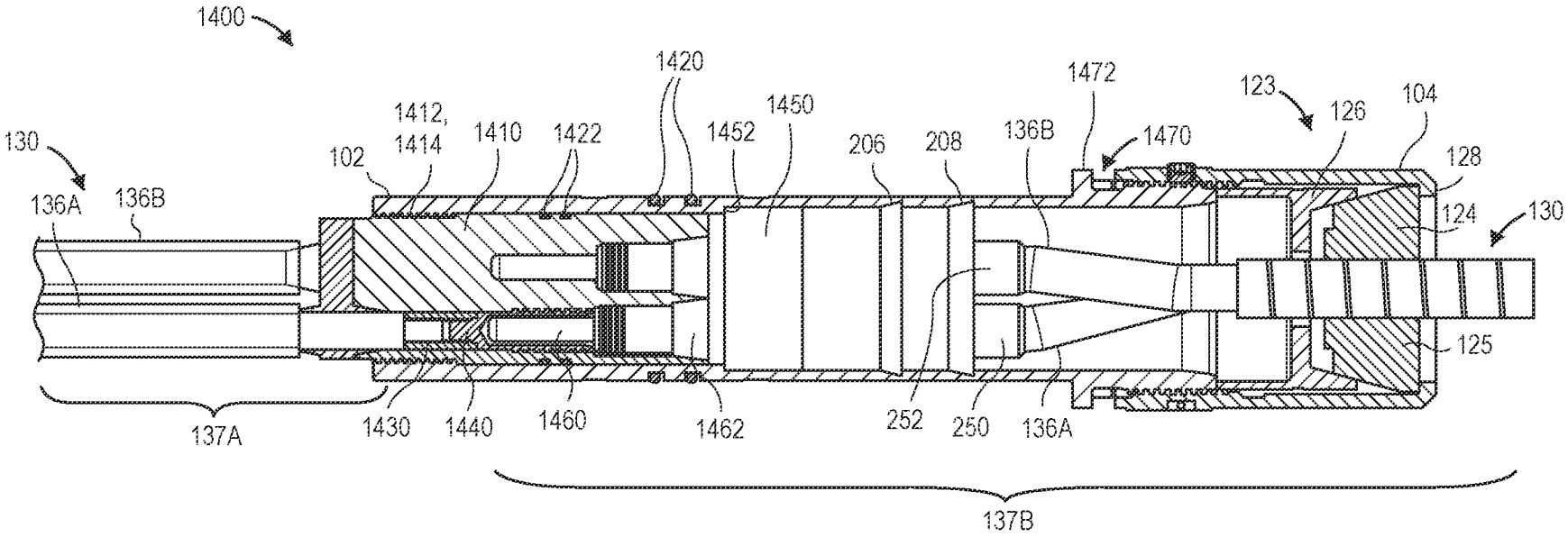
FIG. 14 illustrates a side, cross-sectional view of another wellhead penetrator in a first state, according to an embodiment.

FIG. 14 illustrates a side, cross-sectional view of another wellhead penetrator 1400 in a first state, according to an embodiment. The wellhead penetrator 1400 may be configured to extend into a wellhead, providing a sealed path for electrically-conductive cables, wires, leads, etc., through the wellhead. The wellhead penetrator 1400 may be configured to provide electrical conductivity through the wellhead from a power source at the surface to a pump or another electronic device within the well. The wellhead penetrator 1400 may be similar to the wellhead penetrator 100 described above, and similar reference numbers are used to indicate similar components.

For example, the wellhead penetrator 1400 may include the outer mandrel 102. In an embodiment, the mandrel 102 may not include an encapsulant (e.g., epoxy) therein. The encapsulant may be omitted because a hardness of the encapsulant may make it difficult to inject the encapsulant into the mandrel 102 to fill the inner volume of the mandrel 102, particularly in cold temperatures (e.g., less than about 10 degrees C.).

The wellhead penetrator 1400 may also include a housing (also referred to as a barrier assembly) 1410 that is configured to be positioned at least partially within the mandrel 102. The housing 1410 may include outer threads 1412 that are configured to engage with inner threads 1414 of the mandrel 102. The housing 1410 may be made from any suitable material (e.g., metal, plastic, ceramic, PEEK®, etc.). A cap 1416 may be positioned on and/or coupled to an upper end of the mandrel 102 and/or the housing 1410. The cable 130 (e.g., the wires 136A-136C) may extend through the cap 1416 and into the housing 1410. The cap 1416 may be or include a potted top. For example, the cap 1416 may include a molded encapsulant to hold the cable 130 in place with respect to the housing 1410.

One or more elastomeric O-rings (two are shown: 1420) may be positioned in recesses in the outer surface of the mandrel 102. The O-rings 1420 may be in a lower position (e.g., compared to the wellhead penetrator 100 in FIG. 1), which may reduce the pressure load on the housing 1410. In addition, one or more elastomeric O-rings (two are shown: 1422) may be positioned at least partially (e.g., radially) between the mandrel 102 and the housing 1410.

The housing 1410 may define one or more axial bores (also referred to as housing bores). For example, the housing 1410 may define three axial bores (two are shown) that are circumferentially-offset from one another. Each axial bore may have a connector 1430 positioned therein. The cable 130 (e.g., the wires 136A-136C) may include an upper portion 137A and a lower portion 137B. The upper and lower portions 137A, 137B may parts of the same cable 130 after the cable 130 is cut, or the upper and lower portions 137A, 137B may be different cables. The upper and lower portions 137A, 137B may be separated by an axial gap. The upper and lower portions 137A, 137B may be spliced together within the wellhead penetrator 1400. More particularly, each connector 1430 may be configured to receive the lower end of the upper portion 137A of the cable 130 (e.g., one of the electrically-conductive wires 136A, 136B).

Each axial bore may also have a sleeve 1440 positioned therein. The sleeve 1440 may be coupled to the connector 1430. The sleeve 1440 may be positioned below the connector 1430 (to the right in FIG. 14). The sleeve 1440 may be configured to receive a conductor pin (two are shown: 1460). The conductor pin 1460 may have the upper end of the lower portion 137B of the cable 130 (e.g., one of the electrically-conductive wires 136A, 136B) positioned therein. Thus, the connector 1430, the cable 1440, and/or the conductor pins 1460 may form a splice connection for the cable 130 (e.g., the wires 136A-136C) within the wellhead penetrator 1400.

The wellhead penetrator 1400 may also include a sealing element 1450 that is configured to be positioned at least partially within the mandrel 102. The sealing element 1450 may be axially-adjacent to (e.g., below) the housing 1410. The sealing element 1450 may be made from a resilient material suitable for forming a seal within the mandrel 102, such as, for example, rubber or another elastomeric or polymeric material. In an embodiment, the inner surface of the mandrel 102 may define a shoulder 1452, and the sealing element 1450 may be configured to abut the shoulder 1452. This may remove the housing 1410 from the load path.

The sealing element 1450 may include the one or more conductor pins 1460 that extend into the corresponding sleeves 1440 in the housing 1410. In other words, the conductor pins 1460 may be coupled to or integral with the sealing element 1450. The sealing element 1450 may also include one or more spacers 1462. For example, a spacer 1462 may be positioned at least partially around each conductor pin 1460. The spacers 1462 may be made of a dielectric material.

The sealing element 1450 may include the two skirts 206, 208 describe above, which are separated axially-apart from one another. The skirts 206, 208 may engage the inner diameter surface of the mandrel 102, so as to prevent fluid from leaking past the sealing element 1450. The sealing element 1450 also include three nipples (two are shown: 250, 252) extending from a lower surface thereof. The wires 136A, 136B may extend through the individual nipples 250, 252 such that the nipples 250, 252 extend along the insulation on the wires 136A, 136B to promote formation of a seal therewith. Further, the sealing element 1450 may be self-energized, because at least the skirts 206, 208 thereof are slightly larger in diameter than the inside of the mandrel 102, while openings in the nipples 250, 252 are slightly smaller than the wires 136A, 136B.

The wellhead penetrator 1400 may also include the lock nut 104, which may be positioned at least partially around and/or coupled to a lower end of the mandrel 102. In one embodiment, the wellhead penetrator 1400 may also include the cable lock assembly 123. The cable lock assembly 123 may include the gripping members (two shown: 124, 125) and the conical bowl 126 into which the one or more gripping members 124, 125 are at least partially received. The lip 128 formed on the lower end of the lock nut 104 may engage the one or more gripping members 124, 125, and thus advancing the lock nut 104 toward the mandrel 102 may drive the gripping members 124, 125 farther into the conical bowl 126, thereby pressing the gripping members 124, 125 radially inward.

The wellhead penetrator 1400 may also include or define a recess 1470. In the embodiment shown, the recess 1470 may be defined by/between an outer shoulder 1472 of the mandrel 102 and the upper end of the lock nut 104. In another embodiment, the recess 1470 may be defined by/between two outer shoulders of the mandrel 102. As described below, the recess 1470 may be configured to receive a mandrel retainer to couple the wellhead penetrator 1400 to the wellhead 302 and/or tubing hanger 304.

When the wellhead penetrator 1400 is in the first state (as shown in FIG. 14), the upper ends of the lower portions 137B of the wires 136A-136C of the cable 130 may be positioned within the conductor pins 1460. In addition, when the wellhead penetrator 1400 is in the first state, the conductor pins 1460 may be positioned at least partially within the housing 1410. For example, the conductor pins 1460 may be positioned at least partially within the sleeves 1440. Moreover, when the wellhead penetrator 1400 is in the first state, the sealing element 1450 may be in contact with the shoulder 1452 in the mandrel 102. Furthermore, when the wellhead penetrator 1400 is in the first state, the sealing element 1450 may be spaced apart from (e.g., above) the cable lock assembly 123 and/or the lip 128.

Figure 15:
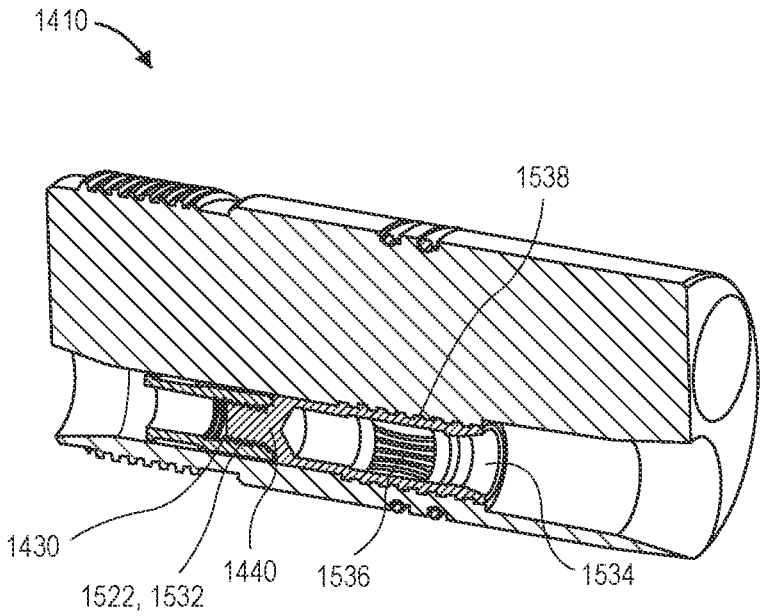
FIG. 15 illustrates a perspective, cross-sectional view of a housing in the wellhead penetrator of FIG. 14, according to an embodiment.
Figure 16:
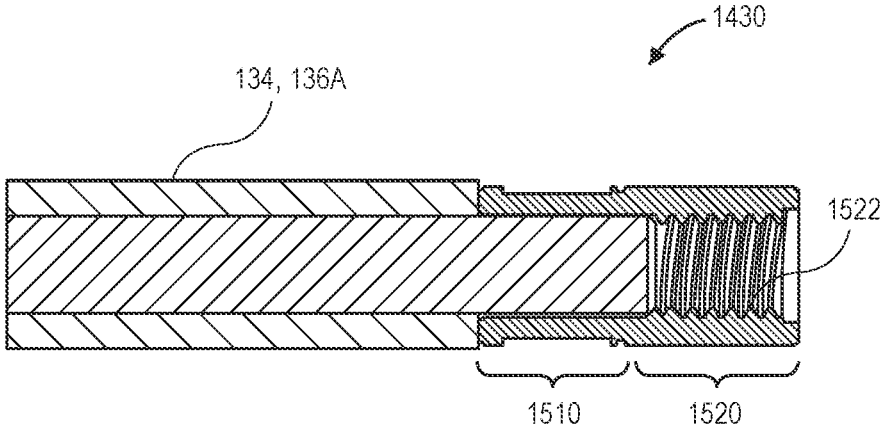
FIG. 16 illustrates a side, cross sectional view of a wire positioned in a connector in the housing, according to an embodiment.

FIG. 15 illustrates a perspective, cross-sectional view of the housing 1410 in the wellhead penetrator 1400, and FIG. 16 illustrates a side, cross sectional view of the wire 136A positioned in the connector 1430, according to an embodiment. The connector 1430 may include a first (e.g., upper) portion 1510 and a second (e.g., lower) portion 1520. The first portion 1510 may be configured to receive the unarmored section 134 of one of the electrically-conductive wires 136A. In one embodiment, the unarmored section 134 of the wire 136A may be crimped in the first portion 1510. The second portion 1520 of the connector 1430 may include inner threads 1522 that are configured to engage outer threads 1532 of the sleeve 1440.

The sleeve 1440 may define an axial bore (also referred to as a sleeve bore) 1534 that extends partially therethrough (e.g., from a lower end thereof toward the connector 1430). In the embodiment shown, the bore 1534 does not extend completely through the sleeve 1440. An inner surface of the sleeve 1440 may include one or more contact bands 1536 that are configured to contact the corresponding conductor pin 1460 when the conductor pin 1460 is positioned within the bore 1534. An outer surface of the sleeve 1440 may include one or more seals 1538 that are configured to engage and seal with an inner surface of the housing 1410. In the embodiment shown, the seals 1538 are a plurality of axially-offset teeth that extend radially outward from the sleeve 1440.

Figure 17:
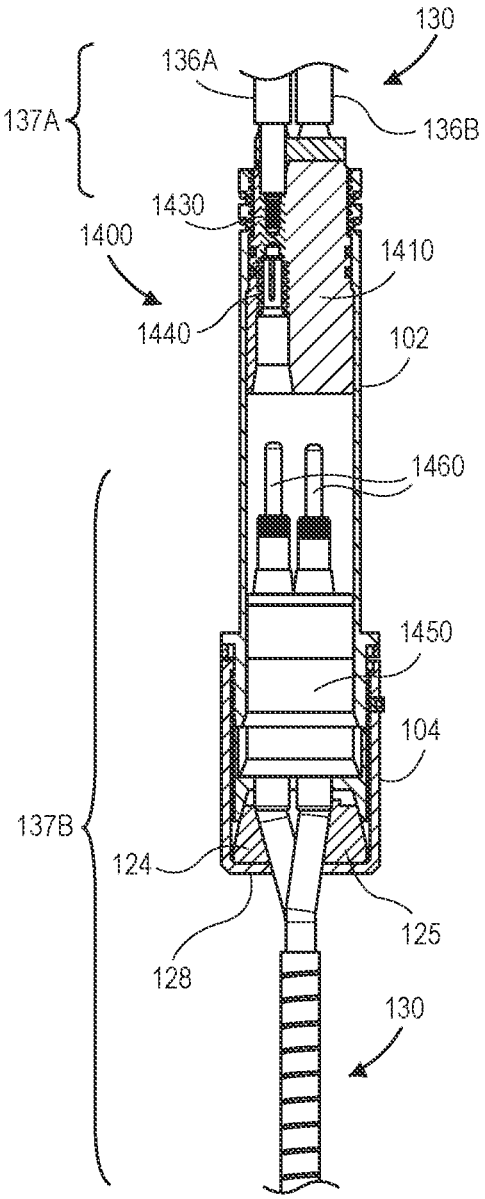
FIG. 17 illustrates a side, cross-sectional view of the wellhead penetrator of FIG. 14 in a second state, according to an embodiment.

FIG. 17 illustrates a side, cross-sectional view of the wellhead penetrator 1400 in a second state, according to an embodiment. When the lower portion 137B of the cable 130 (e.g., below the wellhead penetrator 1400 and/or in the wellbore) is exposed to a downward force that exceeds a predetermined threshold, the wellhead penetrator 1400 is configured to actuate from the first state (FIG. 14) to the second state (FIG. 17).

Actuating into the second state may include the sealing element 1450 moving with respect to the housing mandrel 102 and/or the housing 1410. More particularly, the sealing element 1450 may move downward within the mandrel 102 and away from the housing 1410. This may cause the conductor pins 1460 to be withdrawn from the housing 1410 and/or the sleeves 1440. The sealing element 1440 may move downward until contacting a stop, which prevents further movement. For example, the lower end of the sealing element 1450 may contact the cable lock assembly 123, the gripping members 124, 125, the conical bowl 126, the lip 128, or a combination thereof. Some the lower portion 137B of the electrically-conductive wires 136A, 136B may remain positioned within the mandrel 102, the lock nut 104, the sealing element 1450, and/or the conductor pins 1460 as the wellhead penetrator 1400 actuates into the second state.

Figure 18:
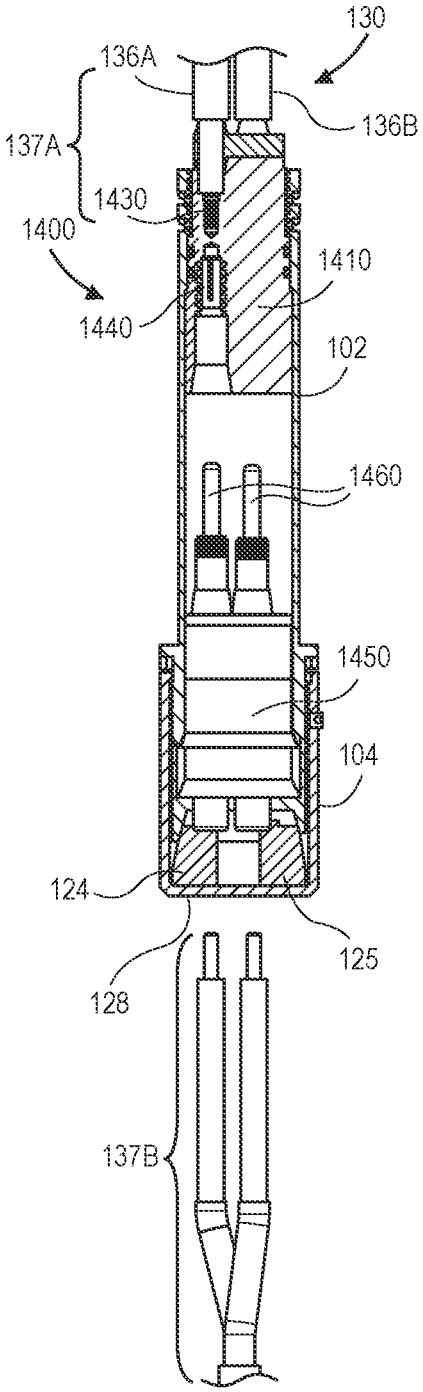
FIG. 18 illustrates a side, cross-sectional view of the wellhead penetrator of FIG. 14 in a third state, according to an embodiment.

FIG. 18 illustrates a side, cross-sectional view of the wellhead penetrator 1400 in a third state, according to an embodiment. The upper ends of the lower portions 137B of the electrically-conductive wires 136A, 136B may be withdrawn from mandrel 102, the lock nut 104, the sealing element 1450, and/or the conductor pins 1460 as the wellhead penetrator 1400 actuates into the third state. More particularly, the sealing element 1450 may remain within the mandrel 102 (e.g., seated on the gripping members 124, 125, the bowl 126, and/or the lip 128), and the downward force exerted on the lower portion 137B of the cable 130 may pull the lower portion 137B of the cable 130 out of the sealing element 1450, conductor pins 1460, the mandrel 102, and/or the lock nut 104 and down into the wellbore. The housing 1410 and/or the sealing element 1450 may continue to provide a pressure barrier within the mandrel 102 after the lower portion 137B of the cable 130 is removed.

In the embodiment shown, the force to withdraw the conductor pins 1460 from the housing 1410 and/or to move the housing 1410 downward within the mandrel 102 may be less than the force to withdraw the lower portion 137B of the cable 130 from the sealing element 1450 and/or the conductor pins 1460. As a result, the conductor pins 1460 may be withdrawn from the housing 1410 and/or the housing 1410 may move downward within the mandrel 102 before the lower portion 137B of the cable 130 is withdrawn from the sealing element 1450 and/or the conductor pins 1460.

In another embodiment, the force to withdraw the conductor pins 1460 from the housing 1410 and/or to move the housing 1410 downward within the mandrel 102 may be greater than the force to withdraw the lower portion 137B of the cable 130 from the sealing element 1450 and/or the conductor pins 1460. As a result, the conductor pins 1460 may remain in the sleeves 1440 in the housing 1410 as the lower portion 137B of the cable 130 is withdrawn from the sealing element 1450, the conductor pins 1460, and/or the mandrel 102.

Figure 19:
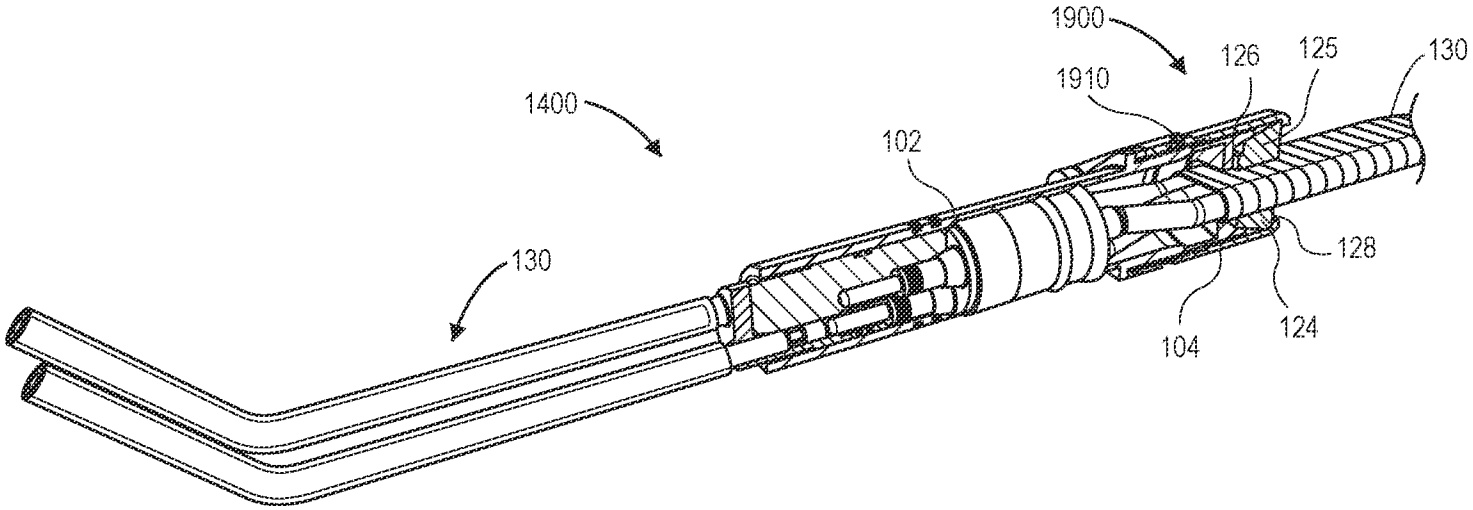
FIG. 19 illustrates a perspective, cross-sectional view of the wellhead penetrator of FIG. 14 showing a cable lock assembly for coupling the wellhead penetrator to the cable, according to an embodiment.

FIG. 19 illustrates a perspective, cross-sectional view of the wellhead penetrator 1400 showing a cable lock assembly 1900 for coupling the wellhead penetrator 1400 to the cable 130, according to an embodiment. The cable lock assembly 1900 may be the same as, or different from, the cable lock assembly 123 described above. For example, the cable lock assembly 1900 may include the gripping members 124, 125, the conical bowl 126, and/or the lip 128 on the lower end of the lock nut 104. As described above, these components may provide a radially-inward gripping force on the cable 130.

In addition, the cable lock assembly 1900 may also include one or more fastening members 1910 that may extend through the lock nut 104. The fastening members 1910 may be or include set screws that extend radially through the lock nut 104 and apply a radially-inward force on the mandrel 102. This may generate an additional radially-inward gripping force on the cable 130.

Figure 20:
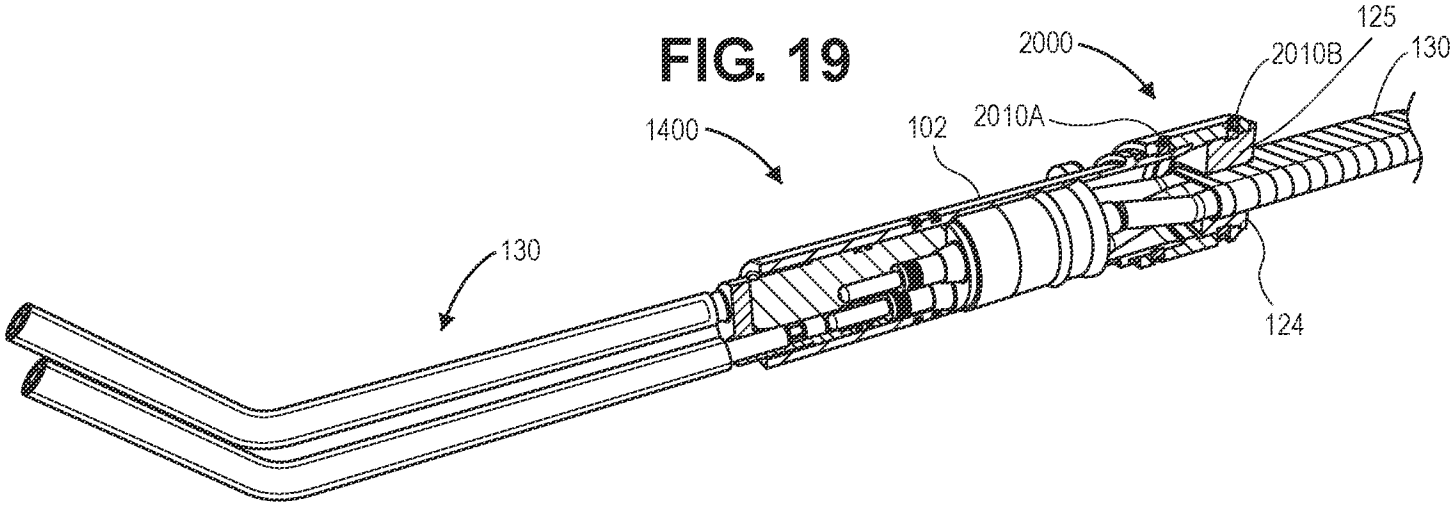
FIG. 20 illustrates a perspective, cross-sectional view of the wellhead penetrator of FIG. 14 showing another cable lock assembly for coupling the wellhead penetrator to the cable, according to an embodiment.

FIG. 20 illustrates a perspective, cross-sectional view of the wellhead penetrator 1400 showing another cable lock assembly 2000 for coupling the wellhead penetrator 1400 to the cable 130, according to an embodiment. This embodiment may omit the conical bowl 126, and the outer surfaces of the gripping members 124, 125 may not be tapered (as they are in FIG. 19). In addition, one or more first fastening members 2010A may extend through the lock nut 104 and apply a first radially-inward force on the mandrel 102. One or more second fastening members 2010B may be axially-offset from the first fastening member(s) 2010A. The second fastening member(s) 2010B may extend through the lock nut 104 and apply a second radially-inward force on the gripping members 124, 125. The first and second radially-inward gripping forces may generate an additional radially-inward gripping force on the cable 130. The fastening members 2010A, 2010B may be or include set screws.

Figure 21A:
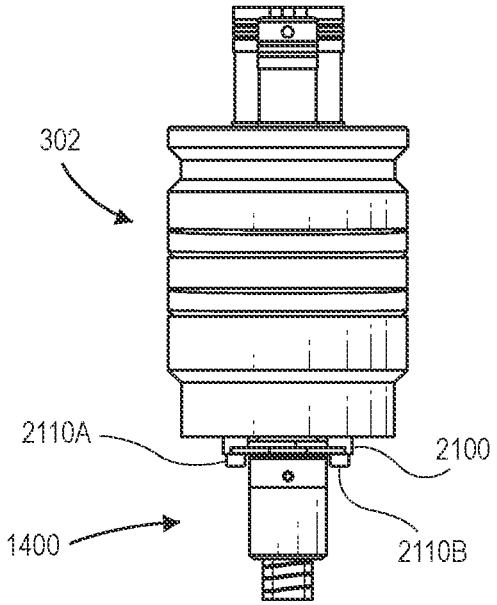
FIG. 21A illustrates a side view of the wellhead penetrator of FIG. 14 positioned at least partially within the wellhead, according to an embodiment.
Figure 21B:
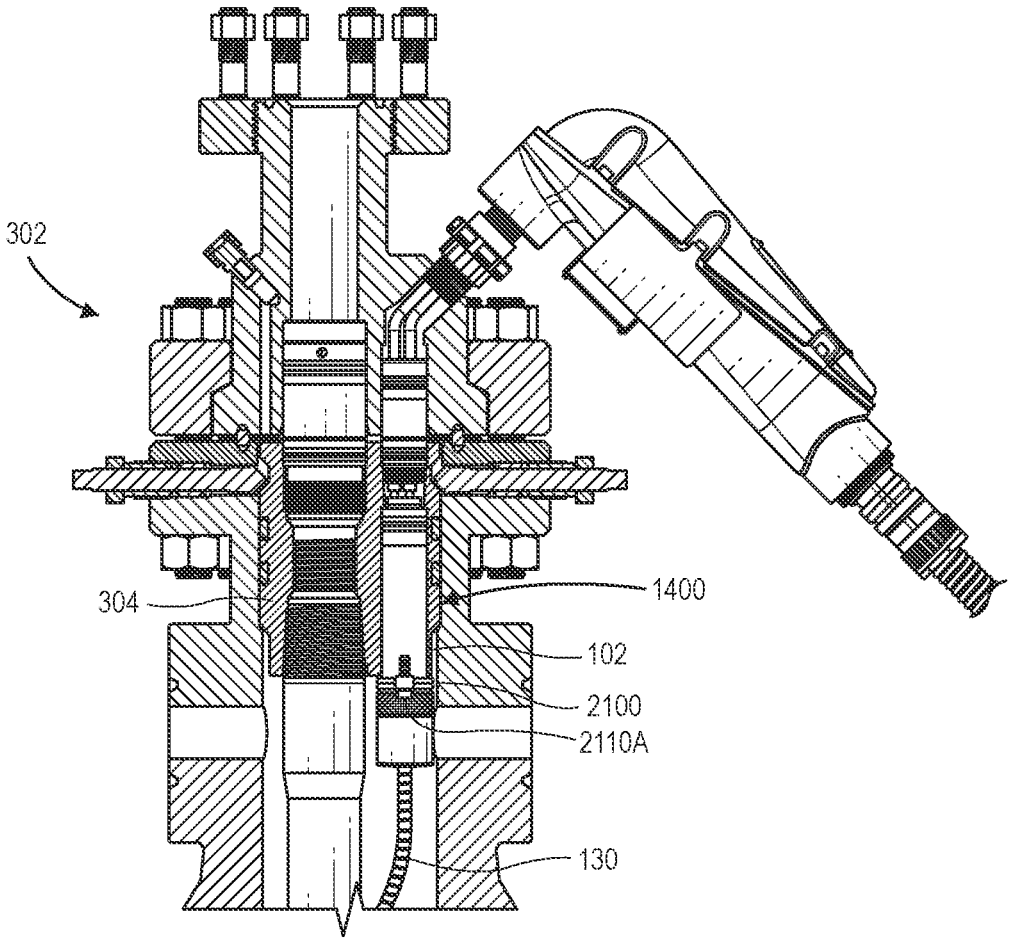
FIG. 21B illustrates a side, cross-sectional view of the wellhead penetrator coupled to the tubing hanger in the wellhead, according to an embodiment.

FIG. 21A illustrates a side view of the wellhead penetrator 1400 positioned at least partially within the wellhead 302, and FIG. 21B illustrates a side, cross-sectional view of the wellhead penetrator 1400 coupled to the tubing hanger 304, according to an embodiment. A mandrel retainer 2100 may be positioned at least partially around the mandrel 102. The mandrel retainer 2100 may be positioned at least partially within the recess 1470 described above with respect to FIG. 14. The recess 1470 may be defined between the outer shoulder 1472 of the mandrel 102 and the lock nut 104. In another embodiment, the recess 1470 may be defined between two outer shoulders of the mandrel 102 that are axially-offset from one another.

The mandrel retainer 2100 may include one or more axial bores formed therethrough. One or more fastening members (two are shown: 2110A, 2110B) may extend (e.g., vertically) through the bores in the mandrel retainer 2100 and be coupled to the wellhead 302 and/or tubing hanger 304. This may couple the wellhead penetrator 1400 to the wellhead 302 and/or tubing hanger 304.

Figure 22A:
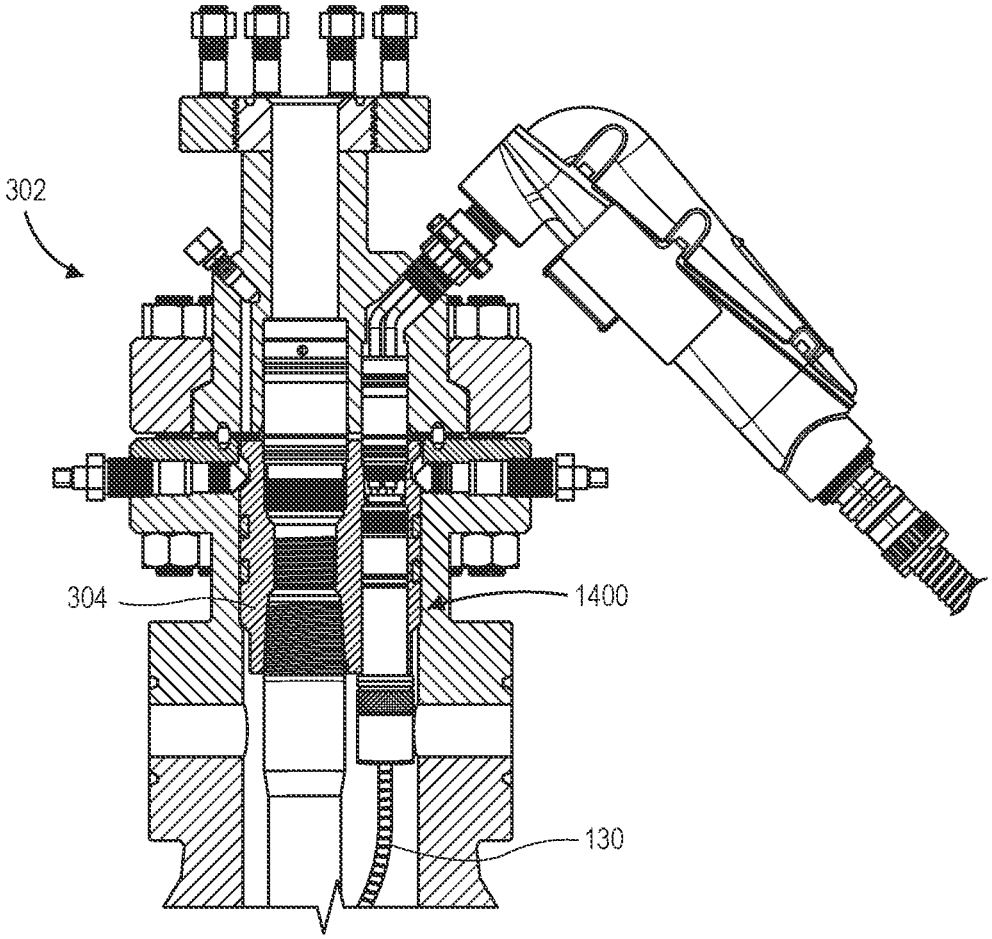
FIG. 22A illustrates a side, cross-sectional view of the wellhead penetrator of FIG. 14 positioned at least partially within the wellhead, according to an embodiment.
Figure 22B:
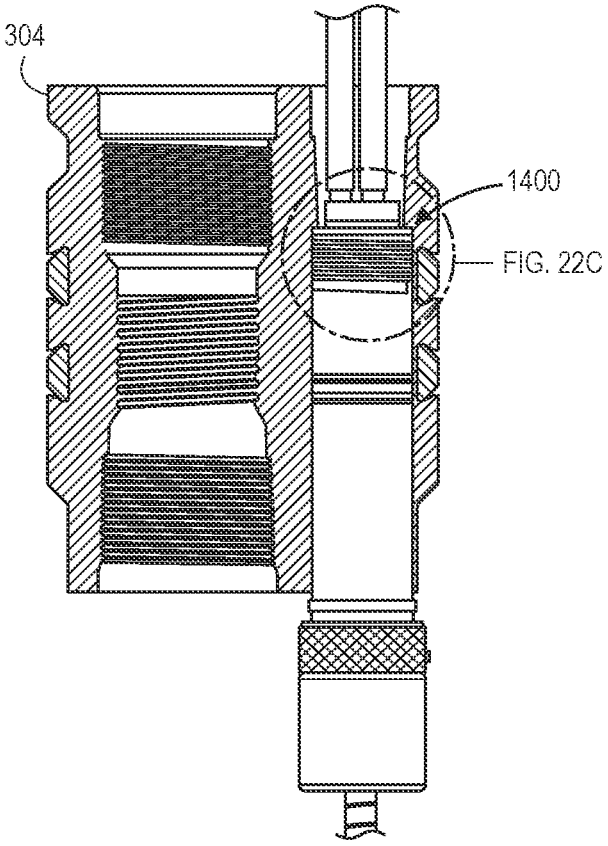
FIG. 22B illustrates an enlarged view of a portion of FIG. 22A, according to an embodiment.
Figure 22C:
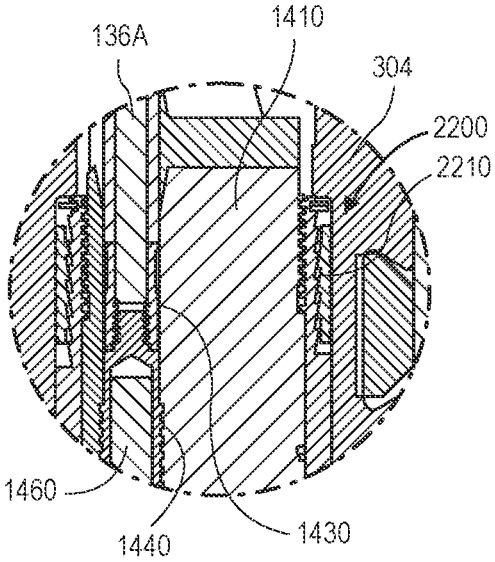
FIG. 22C illustrates an enlarged portion of a portion of FIG. 22B, according to an embodiment.

FIG. 22A illustrates a side, cross-sectional view of the wellhead penetrator 1400 positioned at least partially within the wellhead 302 and/or tubing hanger 304, FIG. 22B illustrates an enlarged view of a portion of FIG. 22A, and FIG. 22C illustrates an enlarged portion of a portion of FIG. 22B, according to an embodiment. The embodiment in FIGS. 22A-22C may omit the fastening members 2110A, 2110B and/or avoid drilling into the wellhead 302 and/or tubing hanger 304.

Instead, as shown in FIG. 22C, the wellhead penetrator 1400 may include an internal clamp assembly 2200. In the embodiment shown, the clamp assembly 2200 may be positioned radially-between the wellhead penetrator 1400 and the tubing hanger 304. In another embodiment, the clamp assembly 2200 may be positioned radially-between the wellhead penetrator 1400 and the wellhead 302. In the embodiment shown, the clamp assembly 2200 may be at least partially axially-aligned with the connector 1430 and/or the sleeve 1440. In another embodiment, the clamp assembly 2200 may be above or below the connector 1430 and/or the sleeve 1440.

The clamp assembly 2200 may include a slip 2210 that is positioned radially-between the wellhead penetrator 1400 and the wellhead 302 or tubing hanger 304. An inner surface of the slip 2210 may include one or more inner gripping features (e.g., notches or teeth) that are configured to engage with corresponding gripping features on the outer surface of the mandrel 102. An outer surface of the slip 2210 may also include one or more outer gripping features that are configured to bite into the inner surface of the wellhead 302 or tubing hanger 304.

In response to a downward force exerted on the cable 130 and/or the wellhead penetrator 1400, the mandrel 102 may ratchet downward with respect to the slip 2210. Each notch/step downward creates an increasing radial gripping force, thereby helping to secure the wellhead penetrator 1400 axially in place and to prevent the wellhead penetrator 1400 from falling down and out of the wellhead 302 or tubing hanger 304.

Figure 23:
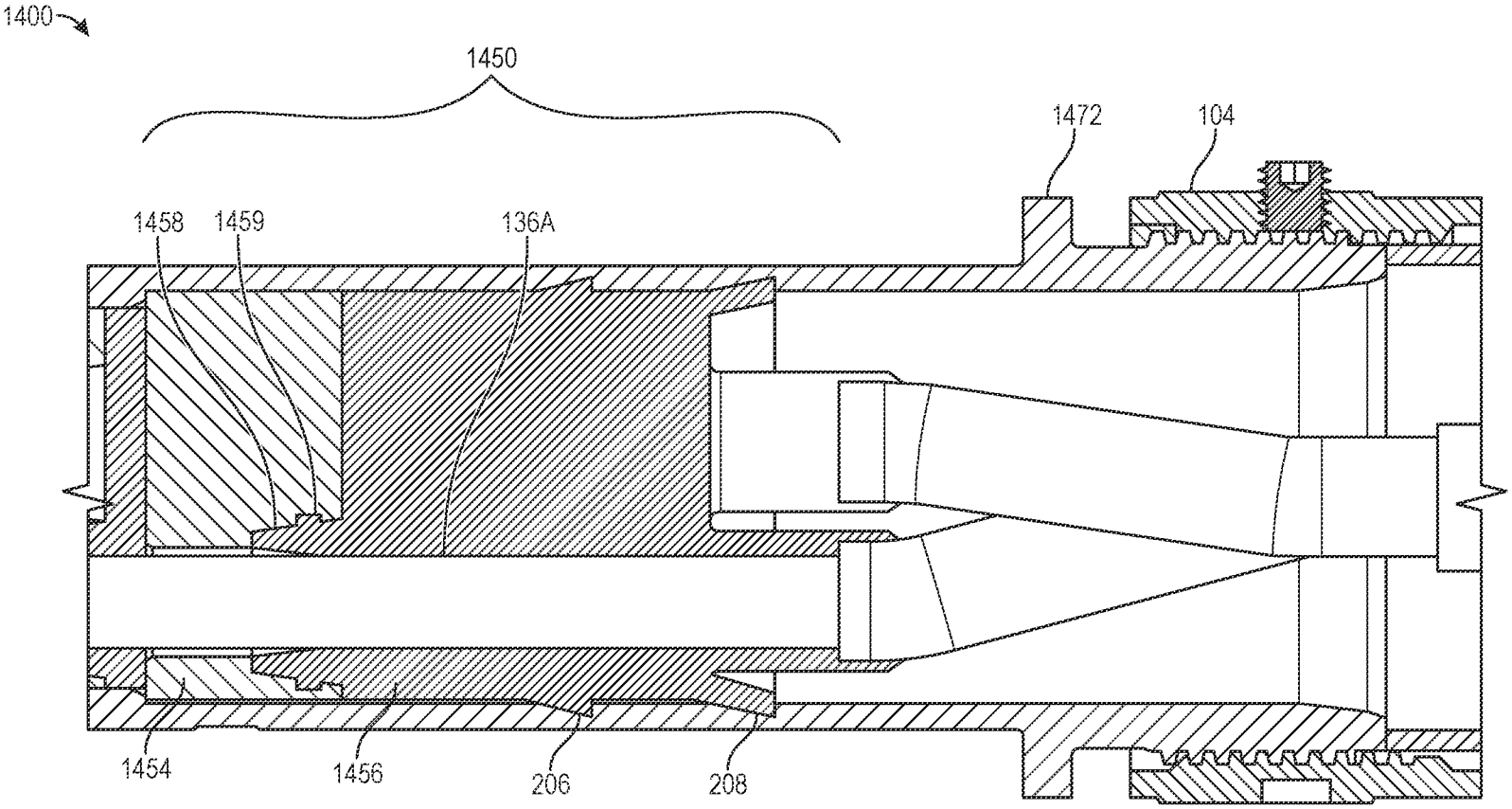
FIG. 23 illustrates a cross-sectional side view of a portion of the wellhead penetrator showing the sealing element including a first (e.g., upper) portion and a second (e.g., lower) portion, according to an embodiment.

FIG. 23 illustrates a cross-sectional side view of a portion of the wellhead penetrator 1400 showing the sealing element 1450 including a first (e.g., upper) portion 1454 and a second (e.g., lower) portion 1456, according to an embodiment. The upper portion 1454 may be or include a metal, and the lower portion 1456 may be or include an elastomeric or polymeric material.

The upper portion 1454 may include or define a recess formed partially (e.g., axially) therethrough. More particularly, the recess may extend from a lower end of the upper portion 1454 toward an upper end thereof. The lower portion 1456 may include an axial protrusion 1458 that is configured to be positioned at least partially within the recess in the upper portion 1454. The protrusion 1458 may include one or more engagement features 1459 that may help to prevent the lower portion 1456 and the protrusion 1458 from being withdrawn/decoupled from the upper portion 1454. The engagement feature(s) 1459 may be or include a radial protrusion (e.g., a barb).

The upper and lower portions 1454, 1456 may be pushed together to assemble the sealing element 1450. The upper portion 1454 may help to prevent extrusion of the (e.g., softer) lower portion 1456 in response to the pushing force. In one example, the pushing force may place the protrusion 1458 under tension.

Figure 24:
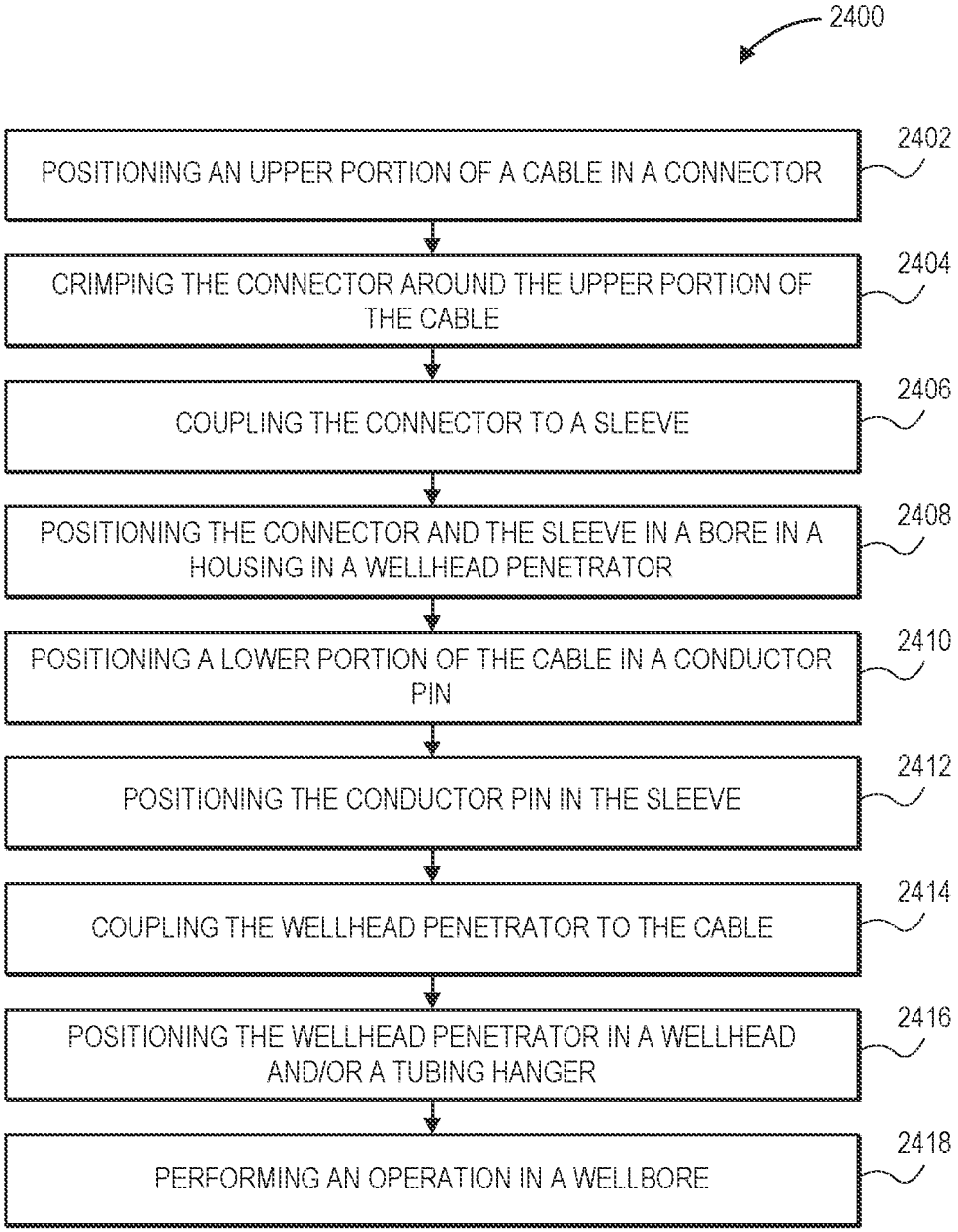
FIG. 24 illustrates a flowchart of a method for splicing the cable within the wellhead penetrator and/or positioning the wellhead penetrator in the wellhead and/or tubing hanger, according to an embodiment.

FIG. 24 illustrates a flowchart of a method 2400 for splicing the cable 130 within the wellhead penetrator 1400 and/or positioning the wellhead penetrator 1400 in the wellhead 302 and/or tubing hanger 304, according to an embodiment. Various steps of the method 2400 may be combined, separated, performed in parallel, and/or performed in a different order than depicted herein without departing from the scope of the present disclosure.

The method 2400 may include positioning the upper portion 137A of the cable 130 in the connectors 1430, as at 2402. This may include positioning the lower ends of the upper portions 137A of the wires 136A-136B in the connectors 1430.

The method 2400 may also include crimping the connectors 1430 around the upper portions 137A of the cable 130, as at 2404. This may include crimping the connectors 1430 around/onto the lower ends of the upper portions 137A of the wires 136A-136B.

The method 2400 may also include coupling the connectors 1430 to the sleeves 1440, as at 2406.

The method 2400 may also include positioning the connectors 1430 and the sleeves 1440 in the bores in the housing 1410, as at 2408.

The method 2400 may also include positioning the lower portion 137B of the cable 130 in the conductor pins 1460, as at 2410. This may include positioning the upper ends of the lower portions 137B of the wires 136A, 136B in the conductor pins 1460.

The method 2400 may also include positioning the conductor pins 1460 in the sleeves 1440, as at 2412. The lower portion 137B of the cable 130 may be positioned within the conductor pins 1460 as the conductor pins 1460 are positioned within the sleeves 1440. At this point, the cable 130 is spliced together within the housing 1410 in the wellhead penetrator 1400 and configured to transfer power and/or communication signals between the upper portion 137A and the lower portion 137B of the cable 130 through the connectors 1430, the sleeves 1440, the conductors 1460, or a combination thereof.

The method 2400 may also include coupling the wellhead penetrator 1400 to the cable 130, as at 2414. This may include securing the wellhead penetrator 1400 to the armored section 132 of the lower portion 137B of the cable 130 using, for example, the cable lock assembly 123 shown in FIG. 14, the cable lock assembly 1900 shown in FIG. 19, the cable lock assembly 2000 shown in FIG. 20, or the like.

The method 2400 may also include positioning the wellhead penetrator 1400 in the wellhead 302 and/or the tubing hanger 304, as at 2416. This may include securing the wellhead penetrator 1400 to the wellhead 302 and/or tubing hanger 304 using the mandrel retainer 2100 and/or the fastening members 2110A, 2110B shown in FIGS. 21A and 21B. This may also or instead include securing the wellhead penetrator 1400 to the wellhead 302 and/or tubing hanger 304 using the clamp assembly 2200 shown in FIGS. 22A-22C.

The method 2400 may also include performing an operation in a wellbore, as at 2418. The operation may be performed below the wellhead 302, the tubing hanger 304, the wellhead penetrator 1400, or a combination thereof. Illustrative operations may include moving a drill string and/or downhole tool within the wellbore, pumping a fluid into the wellbore, setting a packer or plug in the wellbore, or the like. The operation may intentionally or unintentionally exert a downward force on the lower portion 137B of the cable 130, which may exert a downward force on the wellhead penetrator 1400. In another embodiment, the downward force may occur without performing the operation in the wellbore. For example, the downward force may occur in response to the production tubing breaking. In another example, the downward force may occur in response to the cable 130 becoming detached from the pump (e.g., the ESP).

The downward force may cause the wellhead penetrator 1400 to actuate from the first state (FIG. 14) to the second state (FIG. 17) and/or the third state (FIG. 18). This may break the splice of the cable 130. The lower portion 137B of the cable 130 may fall down and out of the wellhead 302, the tubing hanger 304, and the wellhead penetrator 1400. The wellhead penetrator 1400, however, may remain coupled to and/or positioned at least partially within the wellhead 302 and/or the tubing hanger 304.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A wellhead penetrator, comprising:

a mandrel configured to be positioned in a tubing hanger, a wellhead, or both;

a housing positioned at least partially within the mandrel, wherein the housing defines a housing bore formed axially therethrough that is configured to receive upper and lower portions of a cable, and wherein the upper and lower portions are separated by a gap; and a sealing element positioned at least partially within the mandrel and below the housing, wherein the wellhead penetrator is configured to actuate from a first state to a second state in response to a downward force being exerted on the lower portion of the cable, wherein the wellhead penetrator in the first state has the lower portion of the cable positioned at least partially within the housing such that a splice connection exists between the upper and lower portions of the cable, wherein the wellhead penetrator in the second state has the lower portion of the cable withdrawn from the housing, such that the splice connection no longer exists wherein the wellhead penetrator is also configured to actuate from the second state to a third state in response to the downward force being exerted on the lower portion of the cable, and wherein the wellhead penetrator in the third state has the lower portion of the cable withdrawn from the sealing element and the mandrel while the sealing element remains in the mandrel.

2. The wellhead penetrator of claim 1, further comprising a connector positioned at least partially within the housing bore, wherein the connector comprises an upper portion and a lower portion, and wherein the upper portion of the connector is configured to receive the upper portion of the cable.

3. The wellhead penetrator of claim 2, further comprising a sleeve positioned within the housing bore, wherein the sleeve defines a sleeve bore that is configured to receive the lower portion of the cable.

4. The wellhead penetrator of claim 3, wherein an upper portion of the sleeve is configured to be positioned at least partially within the lower portion of the connector.

5. The wellhead penetrator of claim 3, further comprising a conductor pin coupled to the sealing element, wherein the conductor pin is configured to be positioned at least partially within the sleeve bore, and wherein the conductor pin is configured to receive the lower portion of the cable.

6. The wellhead penetrator of claim 5, wherein the sealing element and the conductor pin are configured to move together within the mandrel as the wellhead penetrator actuates from the first state to the second state.

7. The wellhead penetrator of claim 1, wherein the wellhead penetrator in the second state has the lower portion of the cable positioned at least partially within the sealing element, the mandrel, or both.

8. The wellhead penetrator of claim 1, further comprising a lock nut coupled to a lower end of the mandrel, wherein the sealing element contacts a stop in the mandrel, the lock nut, or both when in the second state.

9. The wellhead penetrator of claim 8, wherein the wellhead penetrator in the third state has the lower portion of the cable withdrawn from the sealing element, the mandrel, and the lock nut, and wherein the wellhead penetrator in the third state also has the sealing element positioned at least partially within the mandrel, the lock nut, or both.

10. The wellhead penetrator of claim 1, wherein the sealing element comprises a first portion and a second portion that are axially-offset from one another, wherein the first portion comprises a metal, wherein the second portion comprises an elastomer, a polymer, or both, and wherein the second portion comprises an axial protrusion that is configured to be received within a recess in the first portion.

11. A wellhead penetrator, comprising:

a mandrel;

a housing positioned at least partially within the mandrel, wherein the housing defines a housing bore formed axially therethrough;

a connector positioned at least partially within the housing bore, wherein the connector comprises an upper portion and a lower portion, wherein the upper portion of the connector is configured to receive an upper portion of a cable;

a sleeve positioned at least partially within the housing bore, wherein the sleeve is positioned at least partially within the lower portion of the connector, and wherein the sleeve defines a sleeve bore that extends partially therethrough;

a conductor pin configured to be positioned at least partially within the sleeve bore, wherein the conductor pin is configured to receive a lower portion of the cable; and a sealing element positioned at least partially within the mandrel, wherein the sealing element is positioned at least partially below the housing, wherein the conductor pin is coupled to the sealing element, wherein the sealing element comprises one or more skirts on an outer surface thereof that contact an inner surface of the mandrel, wherein the wellhead penetrator is configured to actuate from a first state to a second state in response to a downward force being exerted on the lower portion of the cable, wherein the wellhead penetrator in the first state has the lower portion of the cable positioned at least partially within the conductor pin, and the conductor pin positioned at least partially within the sleeve, wherein the wellhead penetrator in the second state has the lower portion of the cable positioned at least partially within the conductor pin, and the conductor pin withdrawn from the sleeve; and wherein the conductor pin is prevented from exiting the mandrel when the wellhead penetrator is in the second state.

12. The wellhead penetrator of claim 11, wherein the conductor pin and the sealing element move downward within the mandrel when actuating from the first state to the second state.

13. The wellhead penetrator of claim 11, wherein the wellhead penetrator is also configured to actuate from the second state to a third state in response to the downward force being exerted on the lower portion of the cable, wherein the wellhead penetrator in the third state has the lower portion of the cable withdrawn from the conductor pin, the sealing element, and the mandrel, and wherein the wellhead penetrator in the third state also has the conductor pin and the sealing element positioned at least partially within the mandrel or a lock nut that is coupled to a lower end of the mandrel.

14. The wellhead penetrator of claim 11, further comprising:

a mandrel retainer positioned at least partially within a recess defined at least partially by an outer surface of the mandrel; and a fastening member extending through an axial opening in the mandrel retainer, wherein the fastening member is configured to be coupled to a tubing hanger or wellhead.

15. The wellhead penetrator of claim 11, further comprising a slip positioned at least partially around the mandrel, wherein an inner surface of the slip comprises one or more inner gripping features that are configured to engage with an outer surface of the mandrel, and wherein an outer surface of the slip comprises one or more outer gripping members that are configured to engage with an inner surface of a tubing hanger or a wellhead such that the wellhead penetrator is configured to be coupled to the tubing hanger or wellhead without drilling a hole in the tubing hanger or wellhead.

16. A method, comprising:

positioning a wellhead penetrator at least partially in a tubing hanger, a wellhead, or both, wherein the wellhead penetrator comprises:

a mandrel;

a housing positioned at least partially within the mandrel, wherein the housing defines a housing bore formed axially therethrough that is configured to receive upper and lower portions of a cable; and a sealing element positioned at least partially within the mandrel and below the housing; and performing an operation in a wellbore, which causes a downward force to be exerted on the lower portion of the cable, wherein the wellhead penetrator is configured to actuate from a first state to a second state in response to the downward force, wherein the wellhead penetrator in the first state has the lower portion of the cable positioned at least partially within the housing such that a splice connection exists between the upper and lower portions of the cable, wherein the wellhead penetrator in the second state has the lower portion of the cable withdrawn from the housing, such that the splice connection no longer exists; and wherein the sealing element contacts a stop that prevents the sealing element from exiting the mandrel when the wellhead penetrator is in the second state.

17. The method of claim 16, further comprising:

positioning the upper portion of the cable in a connector;

coupling the connector to a sleeve;

positioning the connector and the sleeve in the housing bore; and positioning the lower portion of the cable in the sleeve.

18. The method of claim 17, further comprising:

positioning the lower portion of the cable in a conductor pin; and positioning the conductor pin in the sleeve, wherein the wellhead penetrator in the first state has the lower portion of the cable positioned at least partially within the conductor pin, and the conductor pin positioned at least partially within the sleeve.

19. The method of claim 18, wherein the wellhead penetrator in the second state has the lower portion of the cable positioned at least partially within the conductor pin, and the conductor pin withdrawn from the sleeve.

20. The method of claim 19, wherein the wellhead penetrator is also configured to actuate from the second state to a third state in response to the downward force, wherein the wellhead penetrator in the third state has the lower portion of the cable withdrawn from the conductor pin, the sealing element, and the mandrel, and wherein the wellhead penetrator in the third state also has the conductor pin and the sealing element positioned at least partially within the mandrel or a lock nut that is coupled to a lower end of the mandrel.

* * * * *